US007464874B2

(12) United States Patent
Donner

(10) Patent No.: US 7,464,874 B2
(45) Date of Patent: Dec. 16, 2008

(54) METHOD AND SYSTEM FOR TRANSPARENT AND SECURE VOTE TABULATION

(76) Inventor: Robert William Donner, 201 Berts Rd., Ben Lomond, CA (US) 95005

( * ) Notice: Subject to any disclaimer, the term of this patent is extended or adjusted under 35 U.S.C. 154(b) by 0 days.

(21) Appl. No.: 11/143,503

(22) Filed: Jun. 2, 2005

(65) Prior Publication Data

US 2006/0186202 A1 Aug. 24, 2006

Related U.S. Application Data

(60) Provisional application No. 60/656,208, filed on Feb. 24, 2005, provisional application No. 60/663,513, filed on Mar. 18, 2005.

(51) Int. Cl.
*G07C 13/00* (2006.01)

(52) U.S. Cl. ..... 235/386; 705/12

(58) Field of Classification Search ..... 235/386, 235/51, 52, 56; 705/12
See application file for complete search history.

(56) References Cited

U.S. PATENT DOCUMENTS 3,659,272 A 4/1972 Price et al.
3,673,573 A 6/1972 Smith
3,937,938 A 2/1976 Matthews
3,947,669 A * 3/1976 Simmons et al. ..... 705/12
4,571,677 A 2/1986 Hirayama et al.
4,598,364 A 7/1986 Gum et al.
4,674,089 A 6/1987 Poret et al.
4,835,675 A 5/1989 Kawai
5,359,608 A 10/1994 Belz et al.
5,970,246 A 10/1999 Moughani et al.
6,540,138 B2 * 4/2003 Hall et al. ..... 235/386
6,834,365 B2 12/2004 Bardsley et al.
6,836,726 B2 12/2004 Sanchez
6,839,869 B2 1/2005 Doi et al.
2001/0013547 A1 8/2001 Kotob et al.
2001/0034640 A1 * 10/2001 Chaum ..... 705/12
2001/0042005 A1 11/2001 McClure
2002/0066780 A1 6/2002 Balolia
2002/0074399 A1 6/2002 Hall et al.
2002/0078358 A1 6/2002 Neff
2002/0092908 A1 7/2002 Chumbley
2002/0107724 A1 8/2002 Openshaw et al.

(Continued)

OTHER PUBLICATIONS

How Bluetooth Technology Works, http://www.bluetooth.com/Bluetooth/Learn/Works/, p. 1, Paragraphs 3-5.*

*Primary Examiner*—Michael G Lee
*Assistant Examiner*—Kristy A Haupt
(74) *Attorney, Agent, or Firm*—Patrick Reilly

(57) ABSTRACT

A system and method to improve the transparency and security of an election are provided. In a first version, a tabulation system includes a paper ballot reader. The ballot reader informs a computational engine of the tabulation system in a digital data format of an informational pattern detected on each paper ballot. The computational engine processes the information provided by the ballot reader in accordance with a system software and in light of instruction and data inputs. The system software and a history of the tabulation system operations are provided as public rectory. The history may include the ballot reader output, computational activity of the tabulation system, computational results of the tabulation system, and instruction and data inputs.

9 Claims, 21 Drawing Sheets

Transparent System: Election Day

U.S. PATENT DOCUMENTS

2002/0128901 A1 9/2002 Gibbs
2002/0128902 A1 9/2002 Gibbs
2002/0133396 A1 9/2002 Barnhart
2002/0148889 A1 10/2002 Vogel
2002/0158118 A1 10/2002 Winnett
2003/0006282 A1 1/2003 Vadura et al.
2003/0034393 A1* 2/2003 Chung ..... 235/386
2003/0042305 A1 3/2003 Jacobs et al.
2003/0046144 A1 3/2003 Clark et al.
2003/0047596 A1 3/2003 Brown
2003/0047605 A1 3/2003 McClure et al.
2003/0062408 A1 4/2003 Barmettler et al.
2003/0062411 A1 4/2003 Chung et al.
2003/0066872 A1 4/2003 McClure
2003/0069783 A1 4/2003 Homma
2003/0094489 A1 5/2003 Wald
2003/0173404 A1 9/2003 Chung et al.
2003/0178479 A1 9/2003 Jimenez
2003/0178484 A1 9/2003 Vadura et al.
2003/0212593 A1 11/2003 Weiss
2004/0024635 A1 2/2004 McClure
2004/0050920 A1 3/2004 Vogel
2004/0060983 A1 4/2004 Davis et al.
2004/0078261 A1 4/2004 Eustis
2004/0140357 A1 7/2004 Cummings
2004/0149825 A1 8/2004 Griffin
2004/0153808 A1 8/2004 Agarwala et al.
2004/0181682 A1 9/2004 Orino et al.
2004/0195323 A1 10/2004 Vadura et al.
2004/0216013 A1 10/2004 Sun
2004/0216092 A1 10/2004 Ayers et al.
2004/0217168 A1 11/2004 Cummings
2004/0221201 A1 11/2004 Seroff
2004/0246281 A1 12/2004 Vanek
2005/0010804 A1 1/2005 Bruening et al.
2005/0010880 A1 1/2005 Schubert et al.
2005/0033553 A1 2/2005 Swaine et al.
2005/0035199 A1 2/2005 Goci
2005/0050159 A1 3/2005 Suraski
2005/0056698 A1 3/2005 Cummings et al.
2005/0060521 A1 3/2005 Wang
2005/0061880 A1 3/2005 Vanek et al.
2005/0065799 A1 3/2005 Dare et al.
2005/0071612 A1 3/2005 DeWitt et al.
2005/0101307 A1 5/2005 Brugge et al.
2005/0127179 A1 6/2005 Rouverel
2005/0145695 A1* 7/2005 Kelly ..... 235/386

* cited by examiner

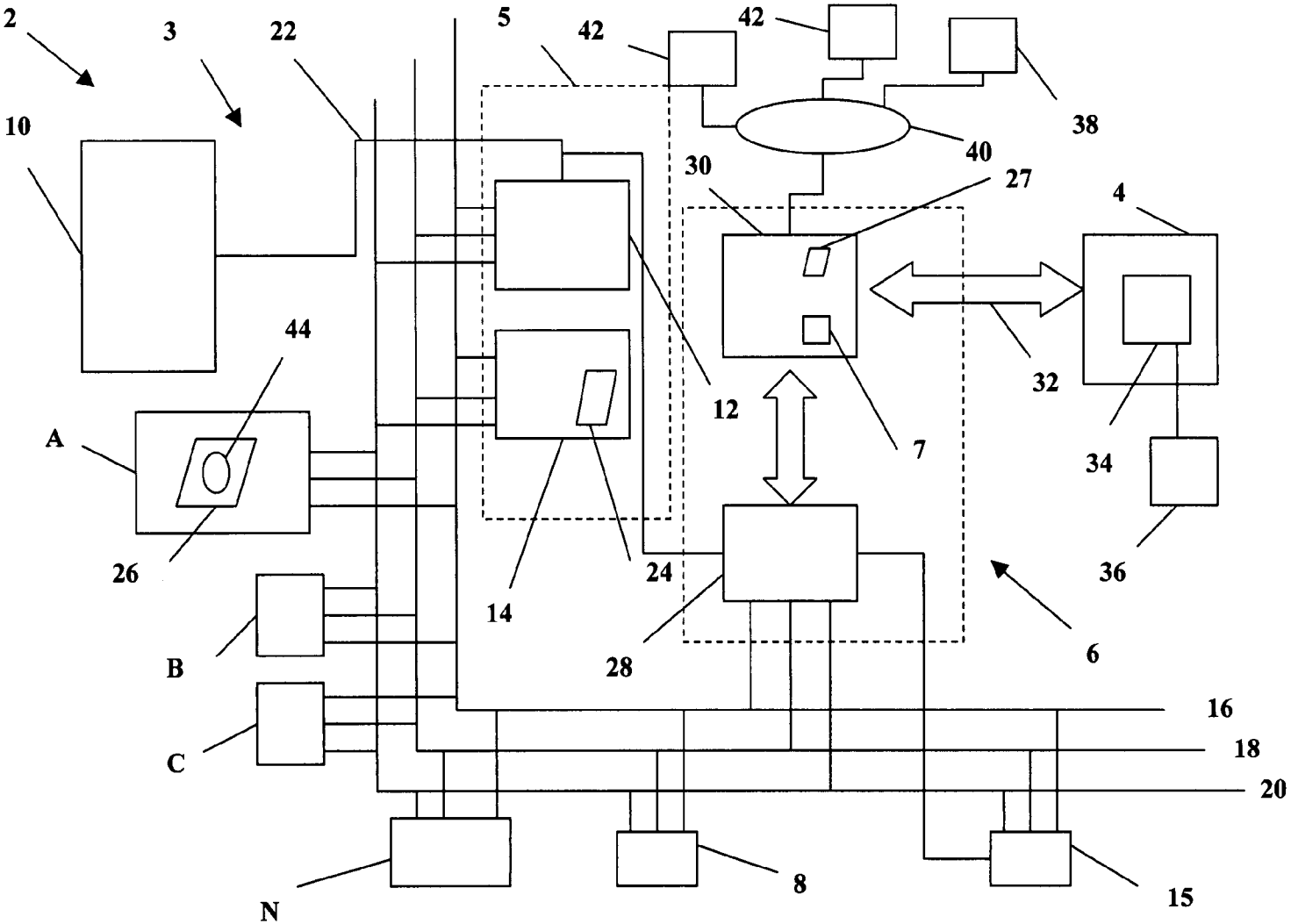
FIG. A

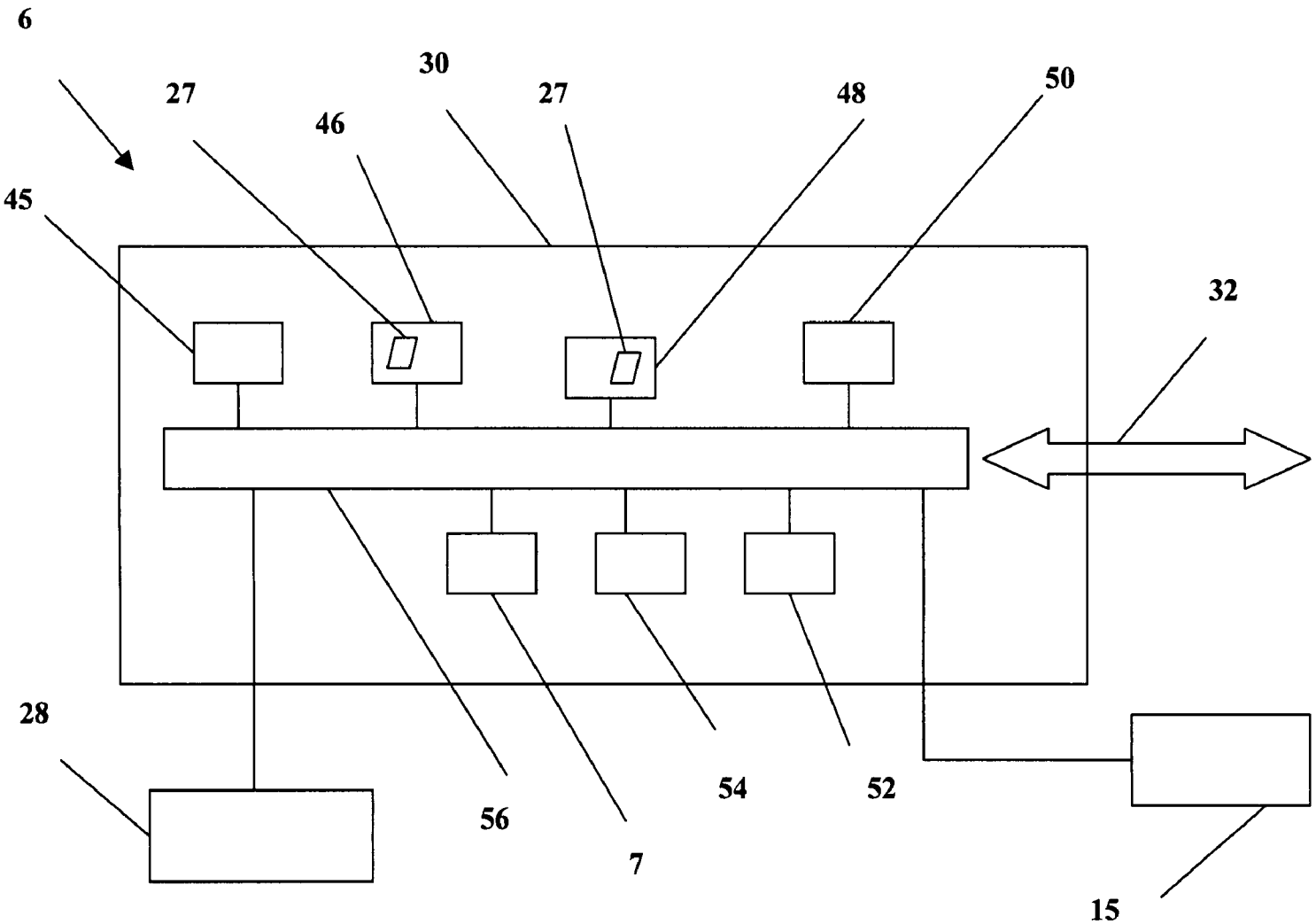
FIG. B

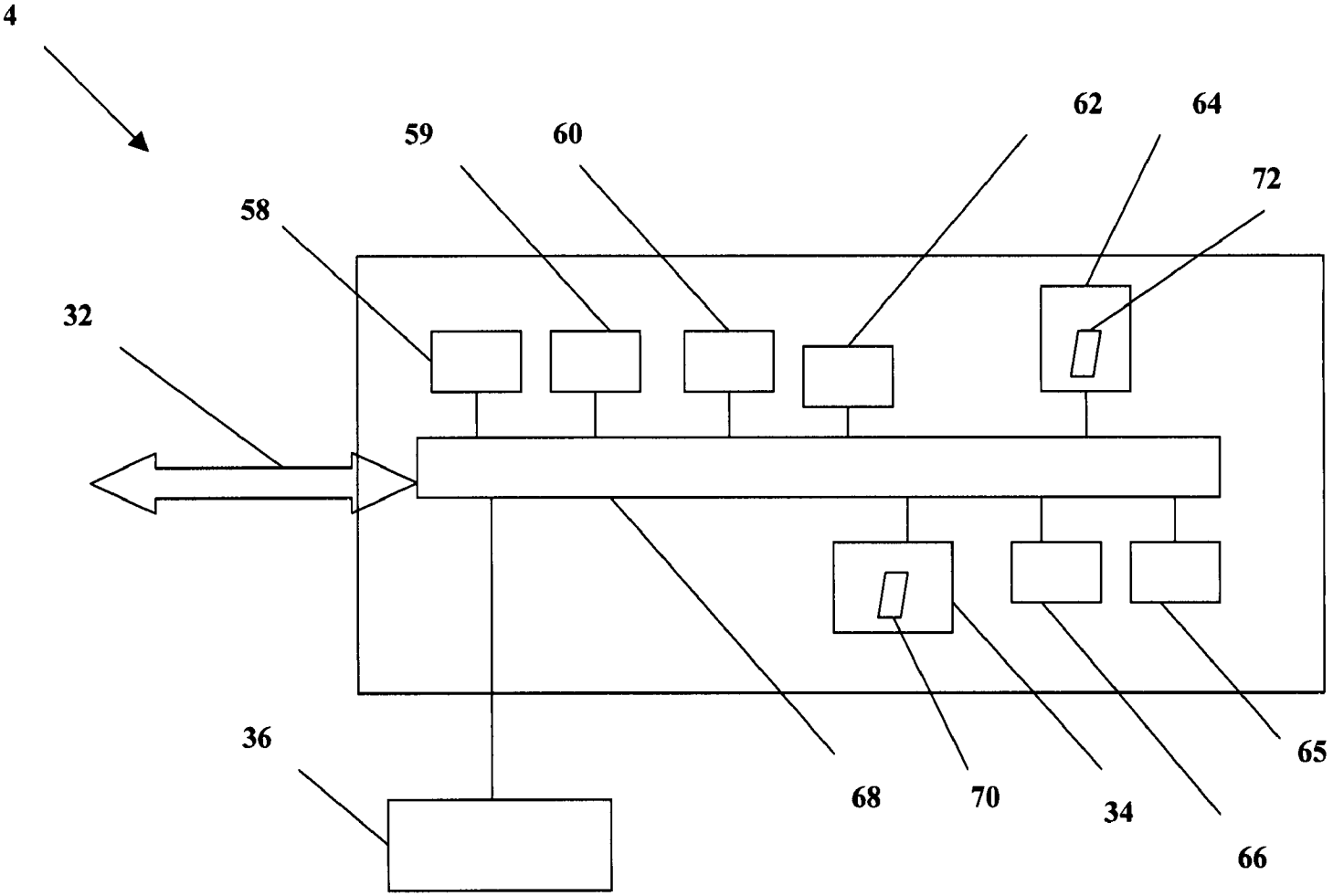
FIG. C

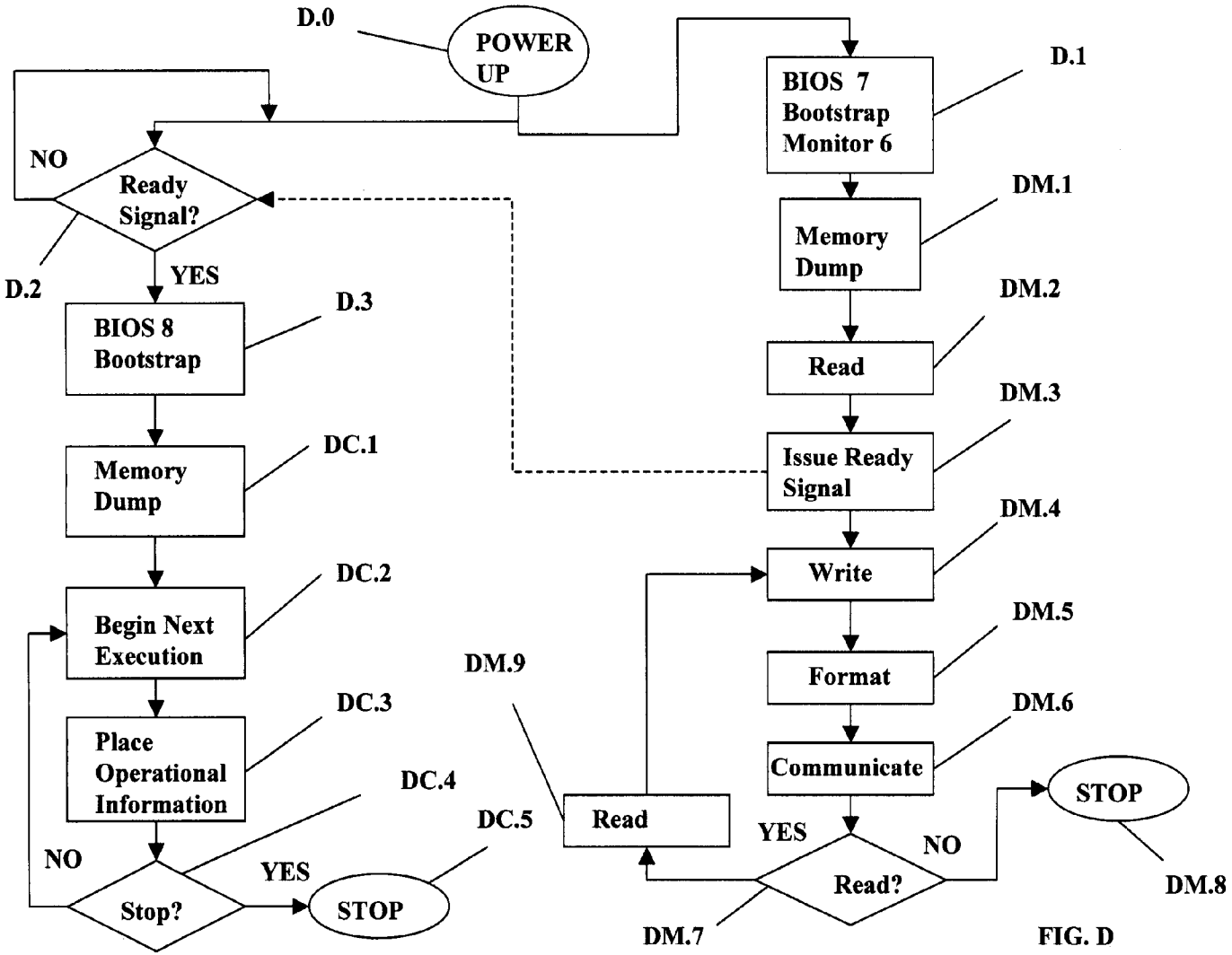
FIG. D

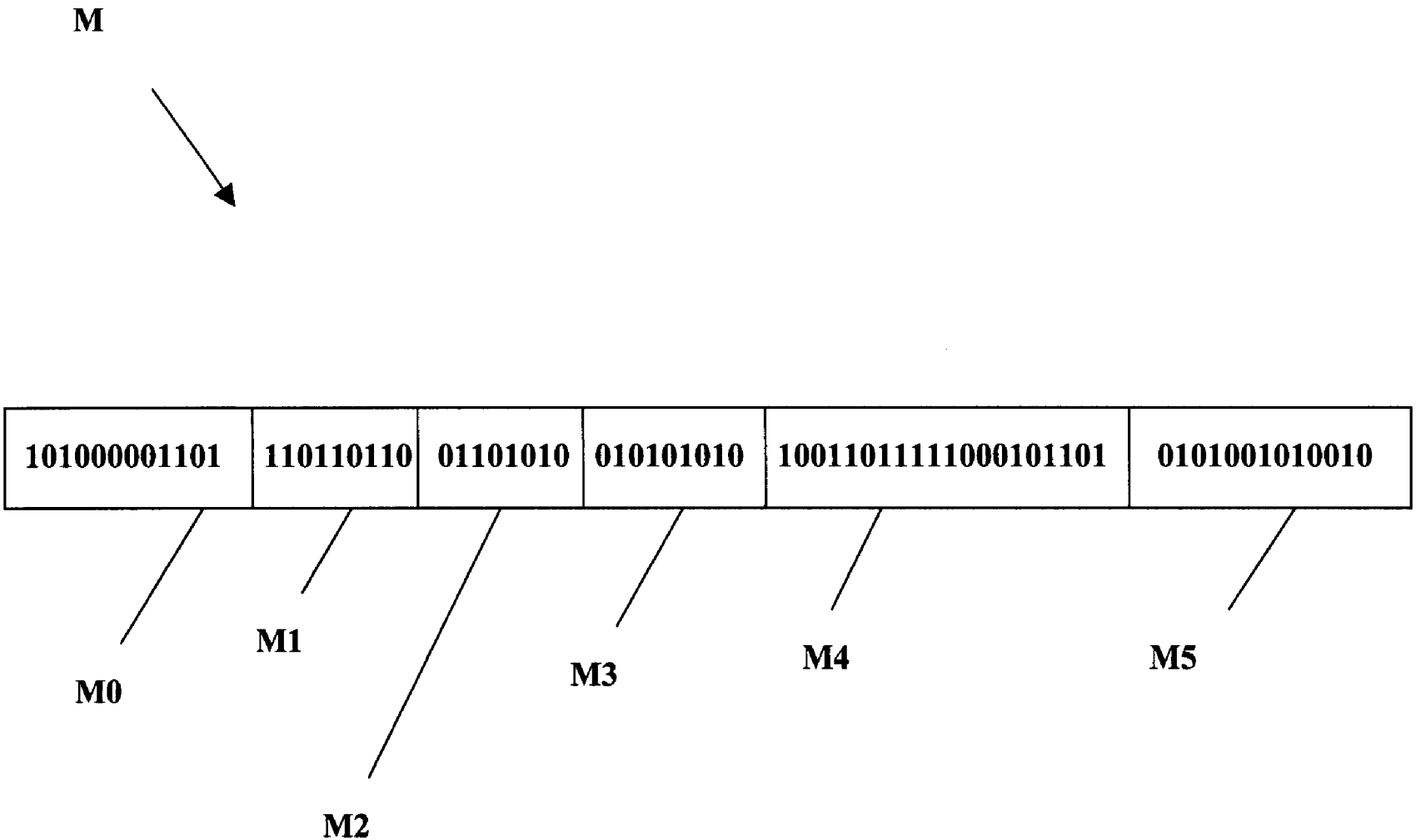
FIG. E

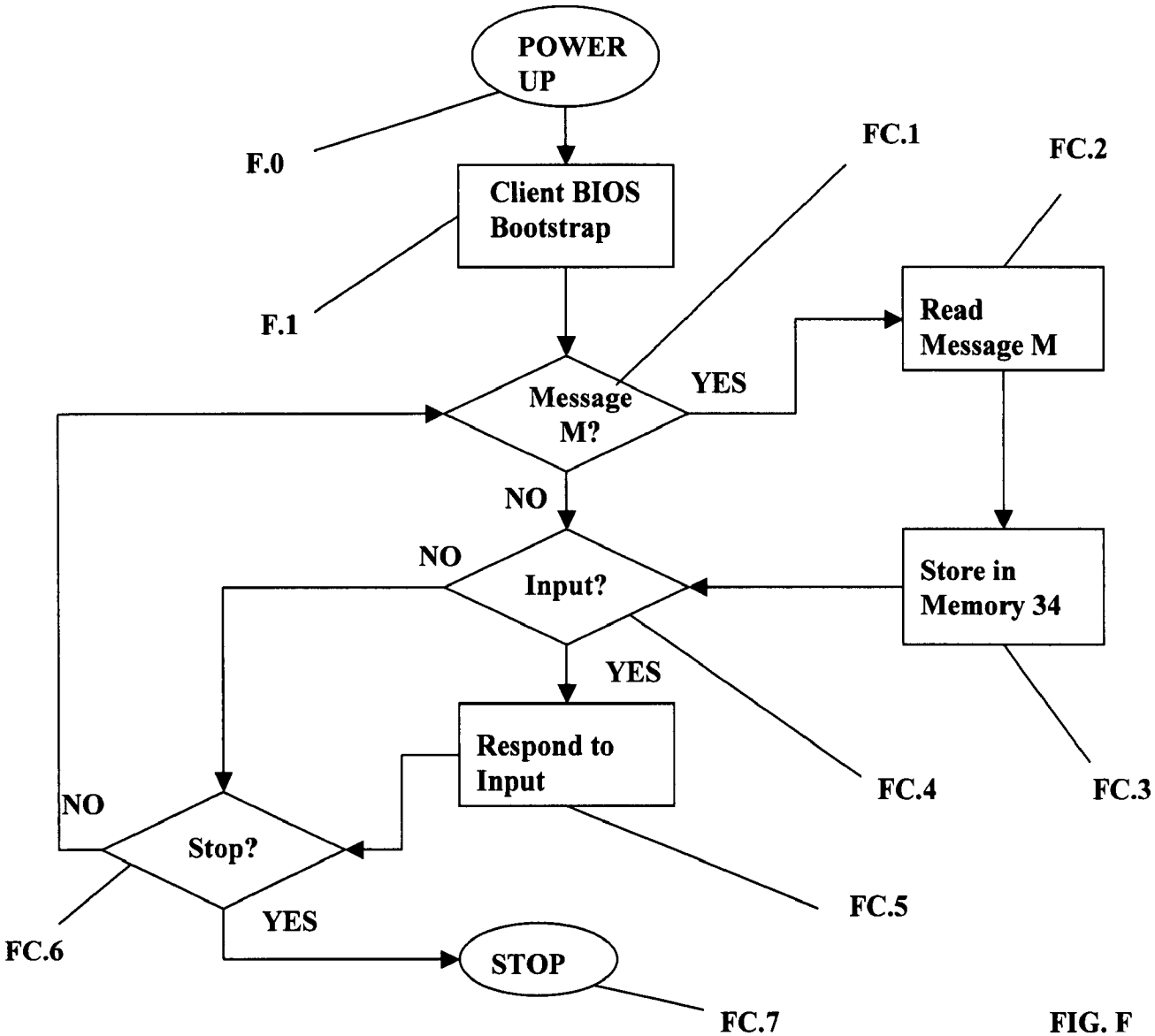
FIG. F

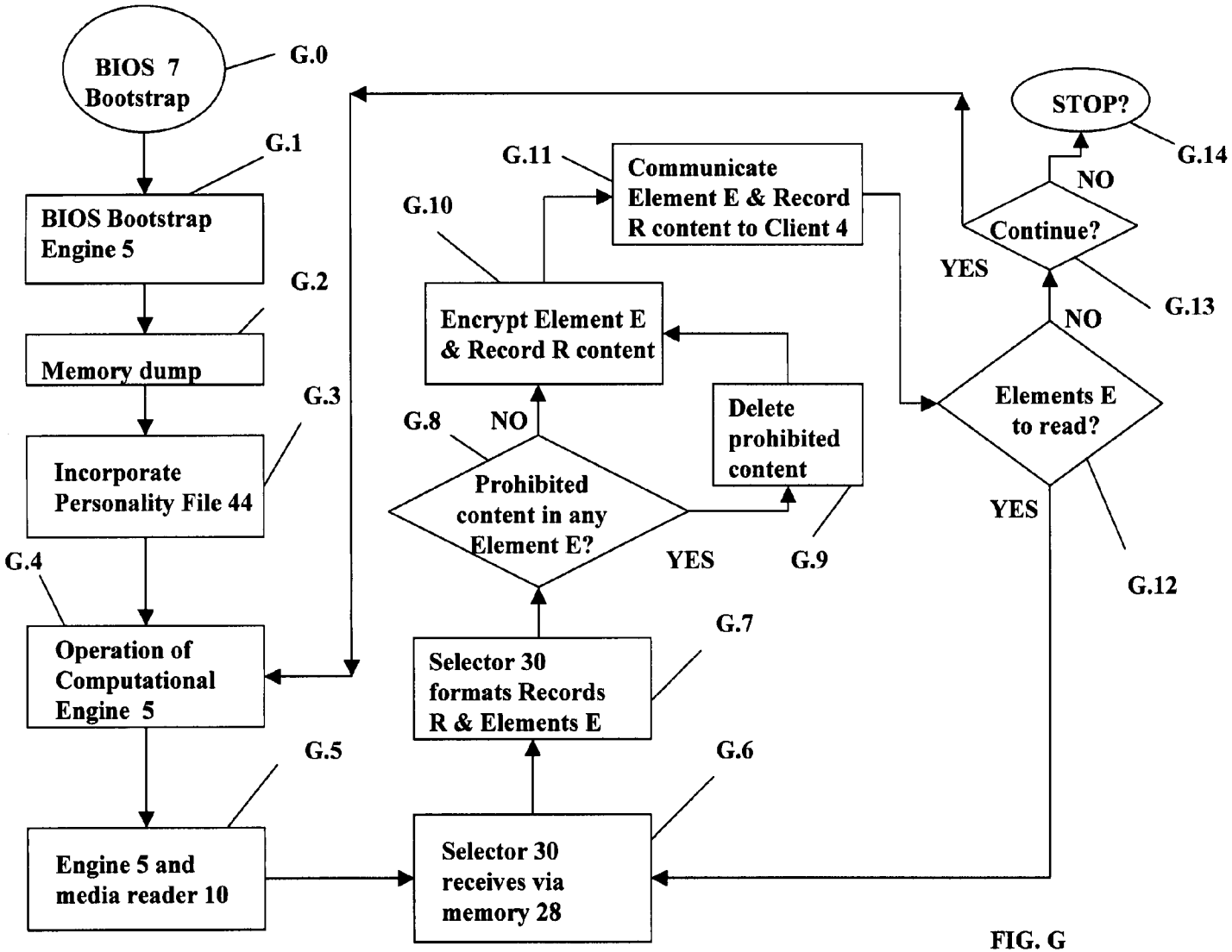
FIG. G

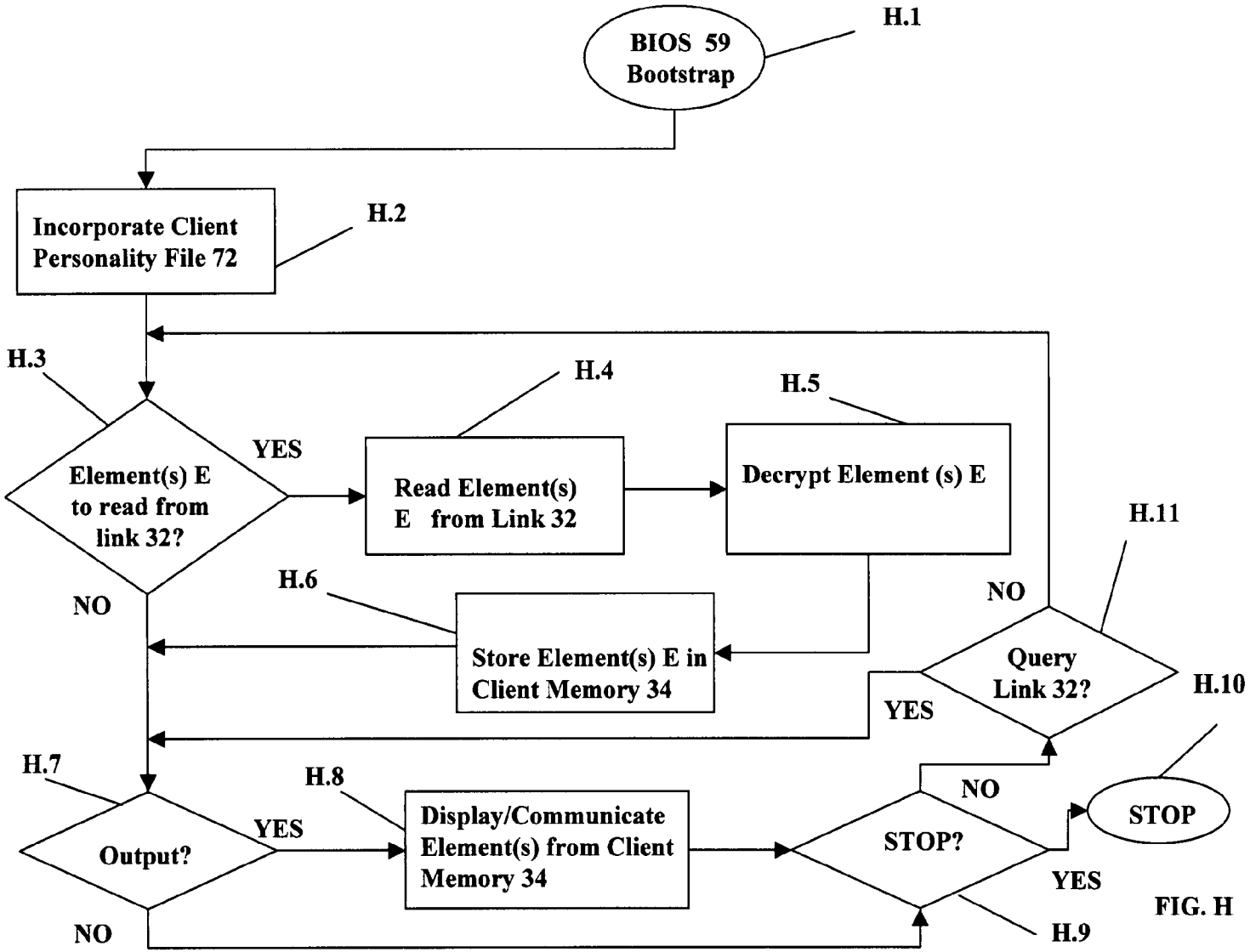
FIG. H

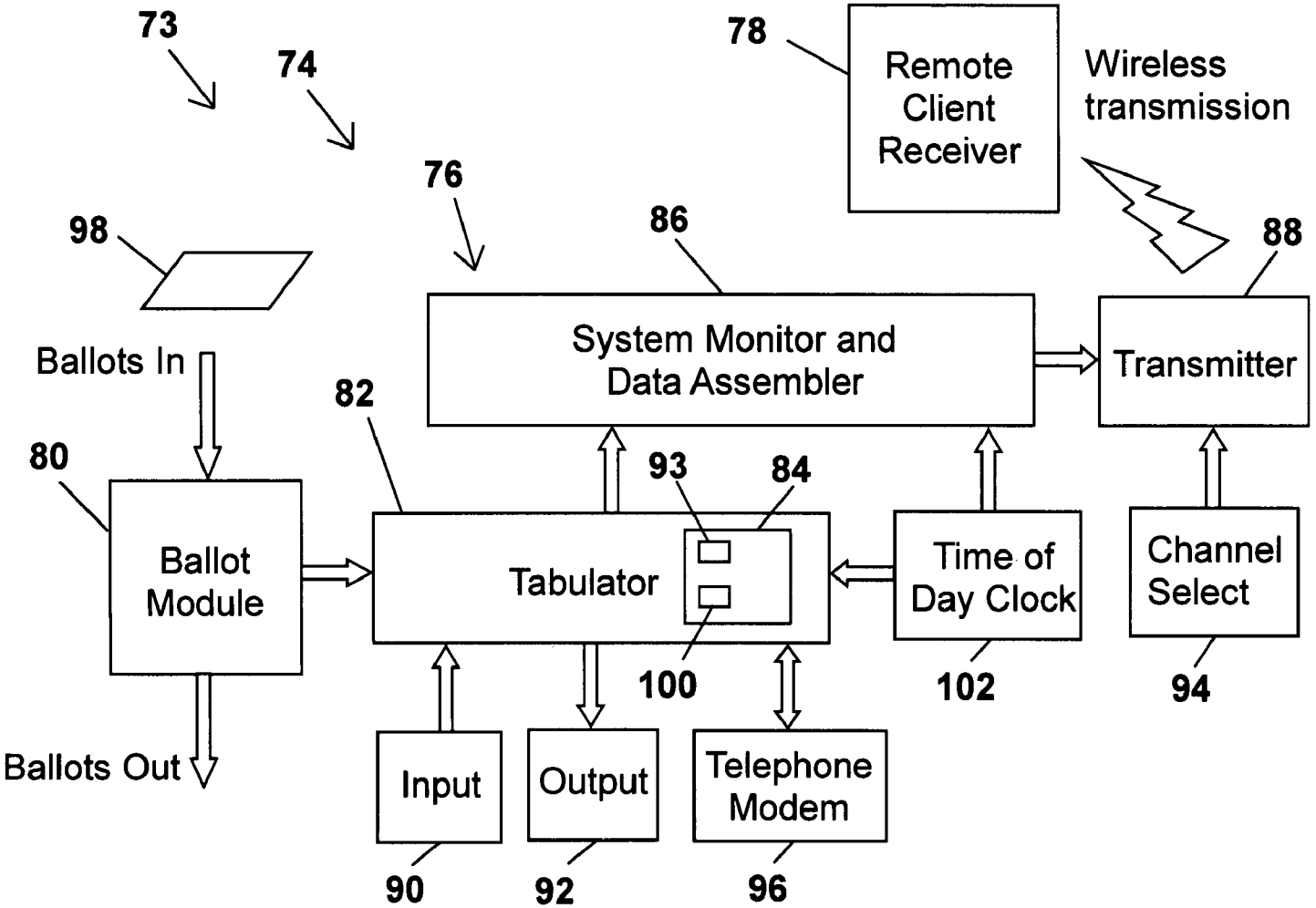
FIG. 1 Transparent Tabulator Schematic

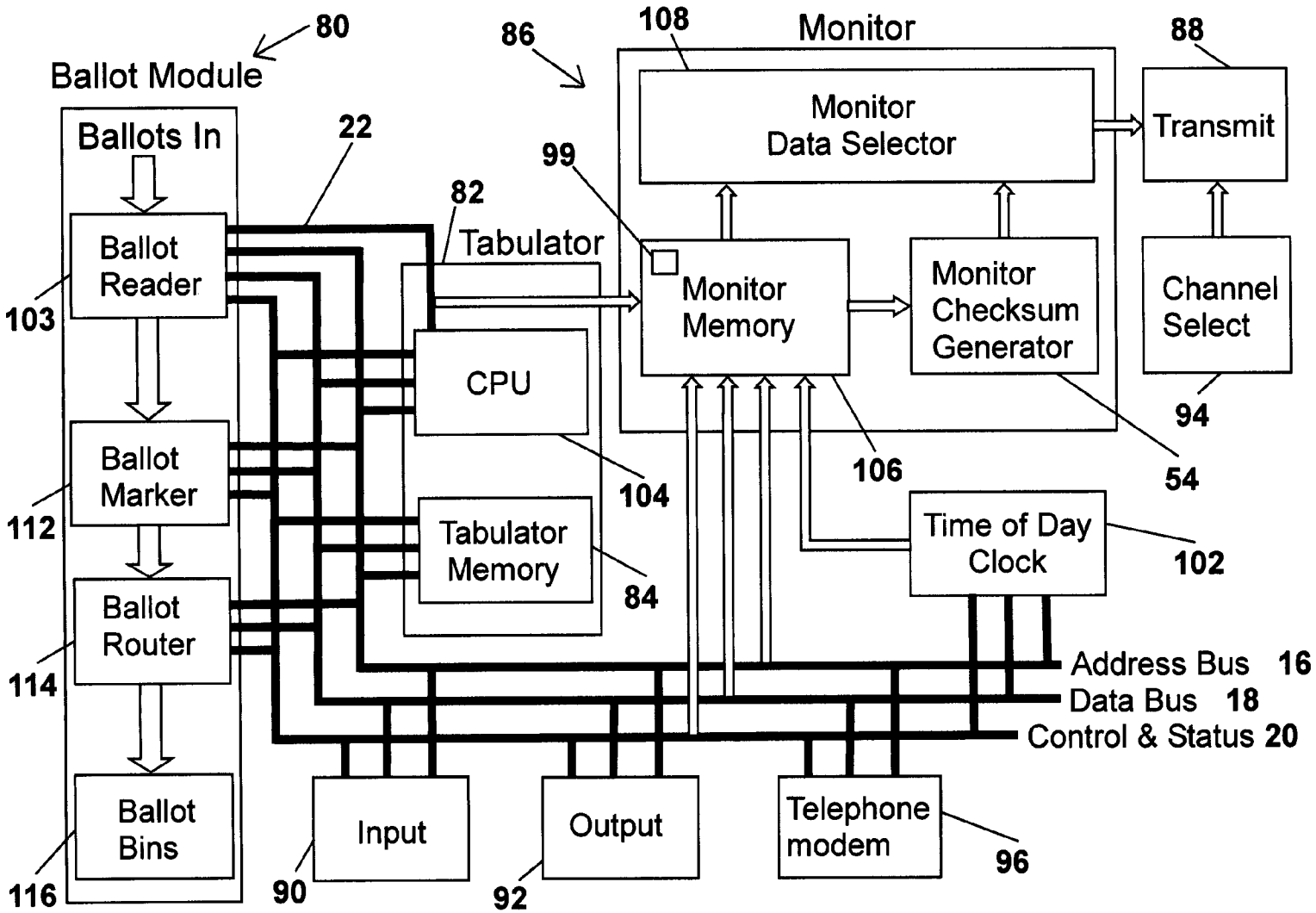
FIG. 2 Detailed Block Schematic

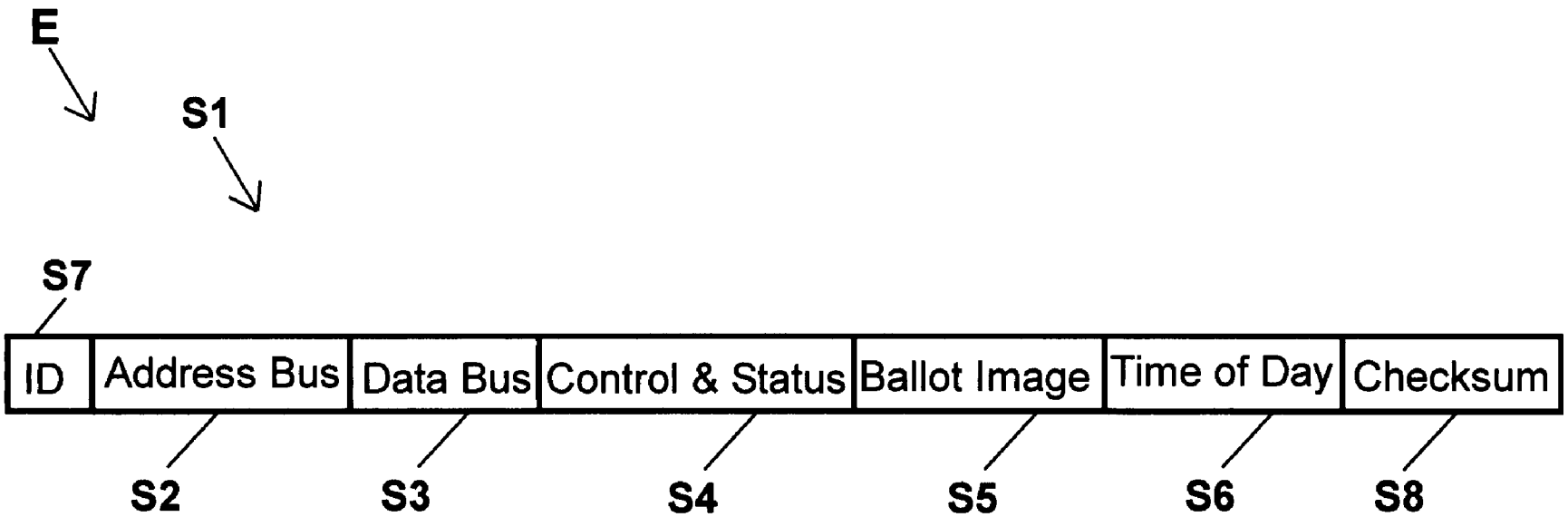
FIG. 3 Element of Session Record

R E

| ID | Address Bus | Data Bus | Control & Status | Ballot Image | Time of Day | Checksum |
|---|---|---|---|---|---|---|
| ID | Address Bus | Data Bus | Control & Status | Ballot Image | Time of Day | Checksum |
| ID | Address Bus | Data Bus | Control & Status | Ballot Image | Time of Day | Checksum |
| ID | Address Bus | Data Bus | Control & Status | Ballot Image | Time of Day | Checksum |
| ID | Address Bus | Data Bus | Control & Status | Ballot Image | Time of Day | Checksum |
| ID | Address Bus | Data Bus | Control & Status | Ballot Image | Time of Day | Checksum |

○
○
○

E

| ID | Address Bus | Data Bus | Control & Status | Ballot Image | Time of Day | Checksum |
|---|---|---|---|---|---|---|
| ID | Address Bus | Data Bus | Control & Status | Ballot Image | Time of Day | Checksum |

FIG. 4 Session Record for One Ballot

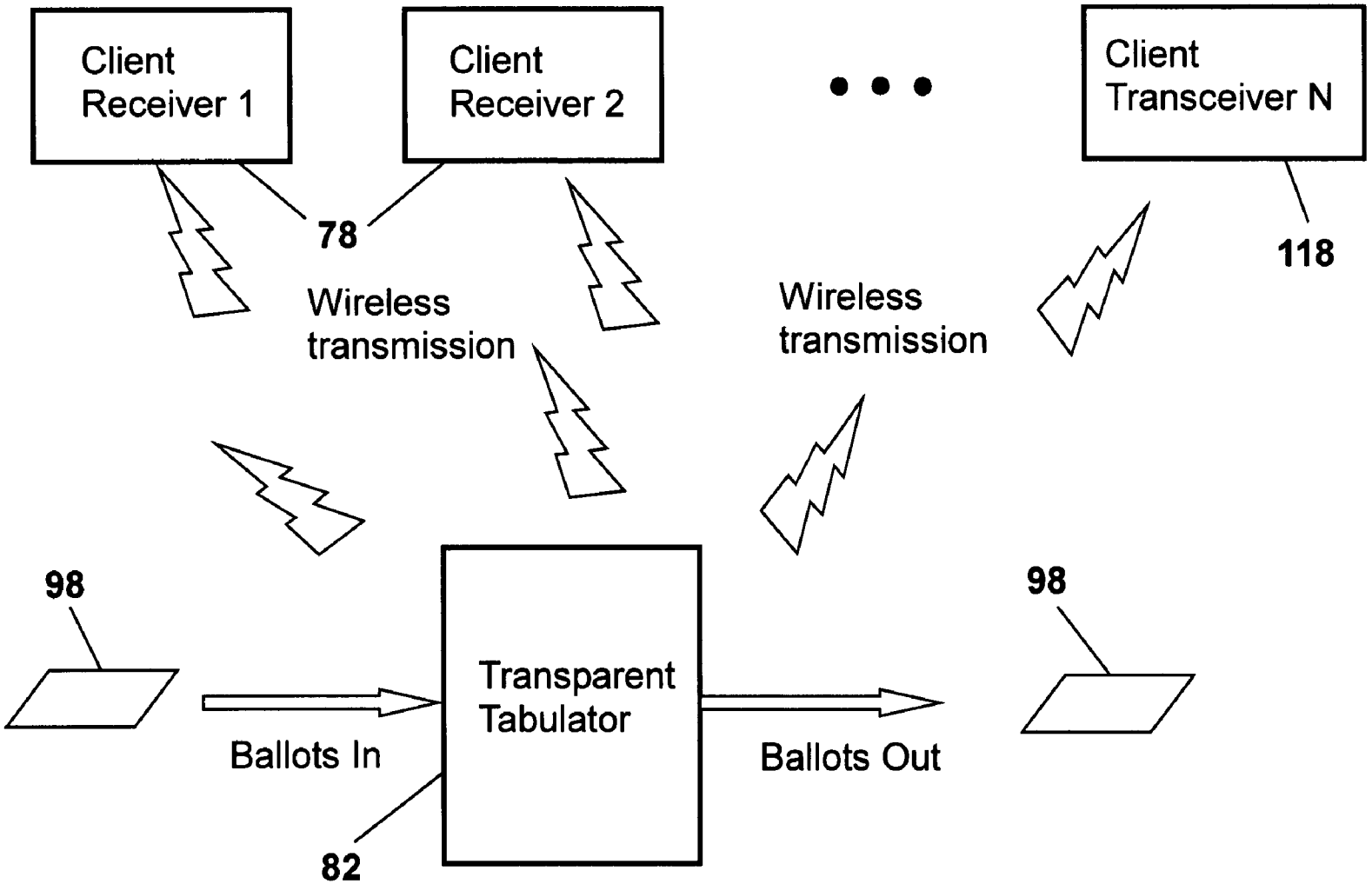
FIG. 5 First Preferred Embodiment Vote System

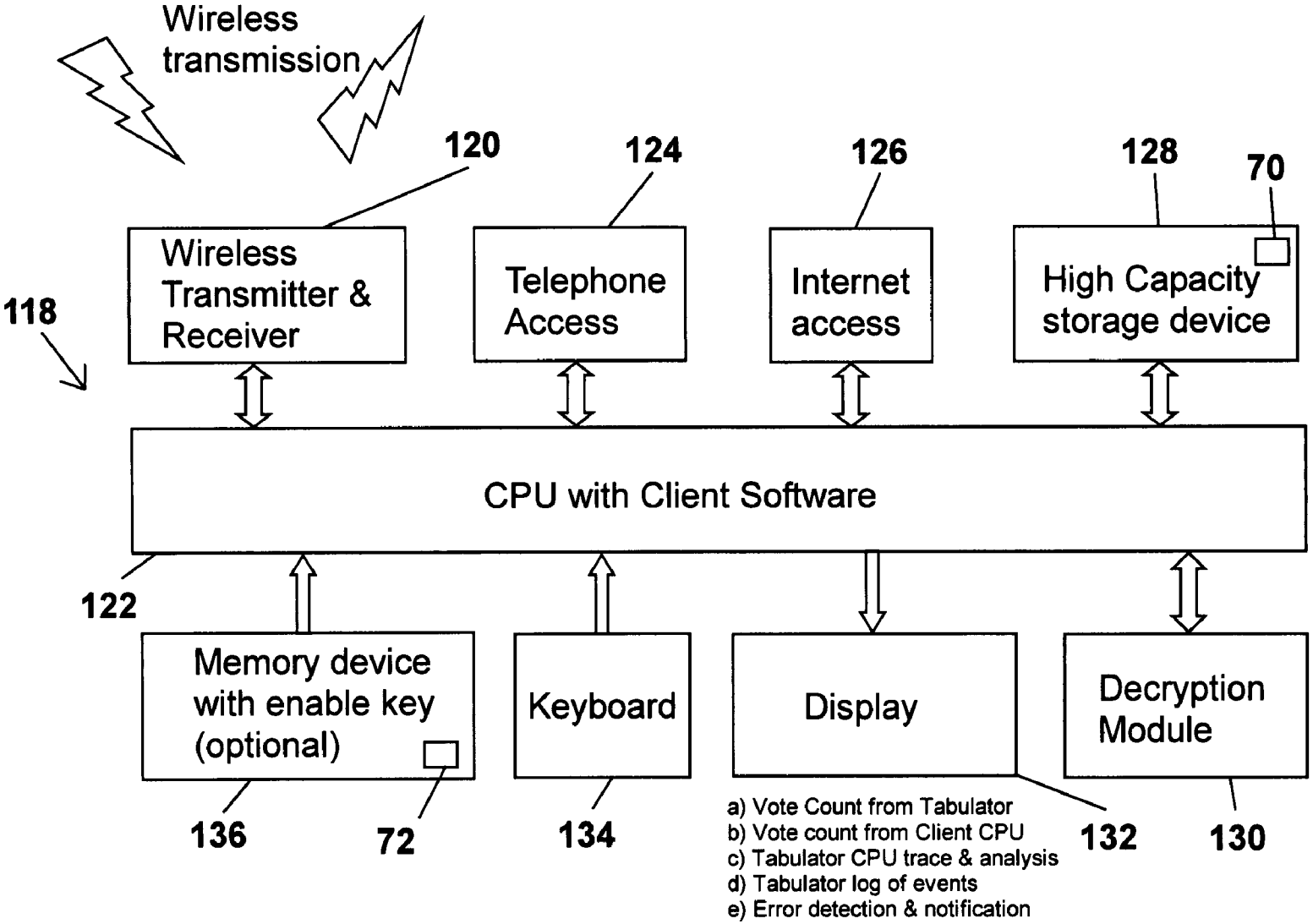
FIG. 6 Client Transceiver Schematic

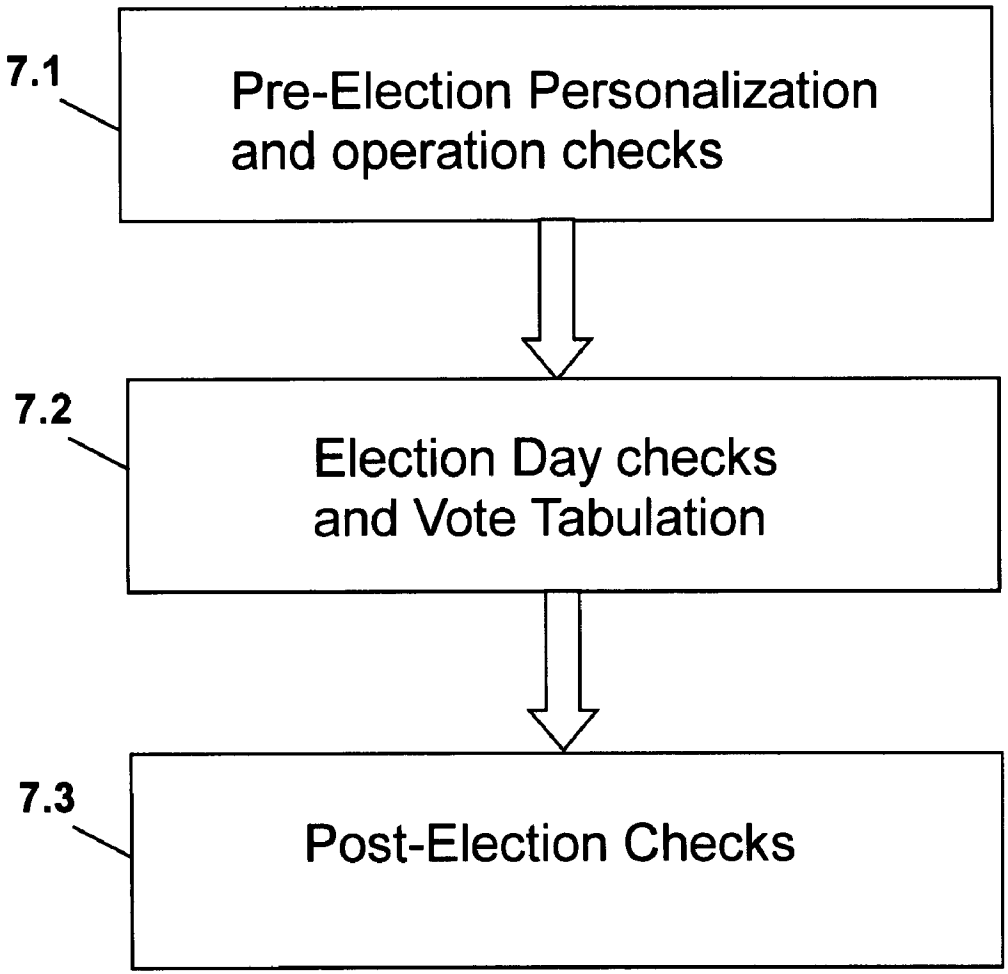
FIG. 7 Operation Phases

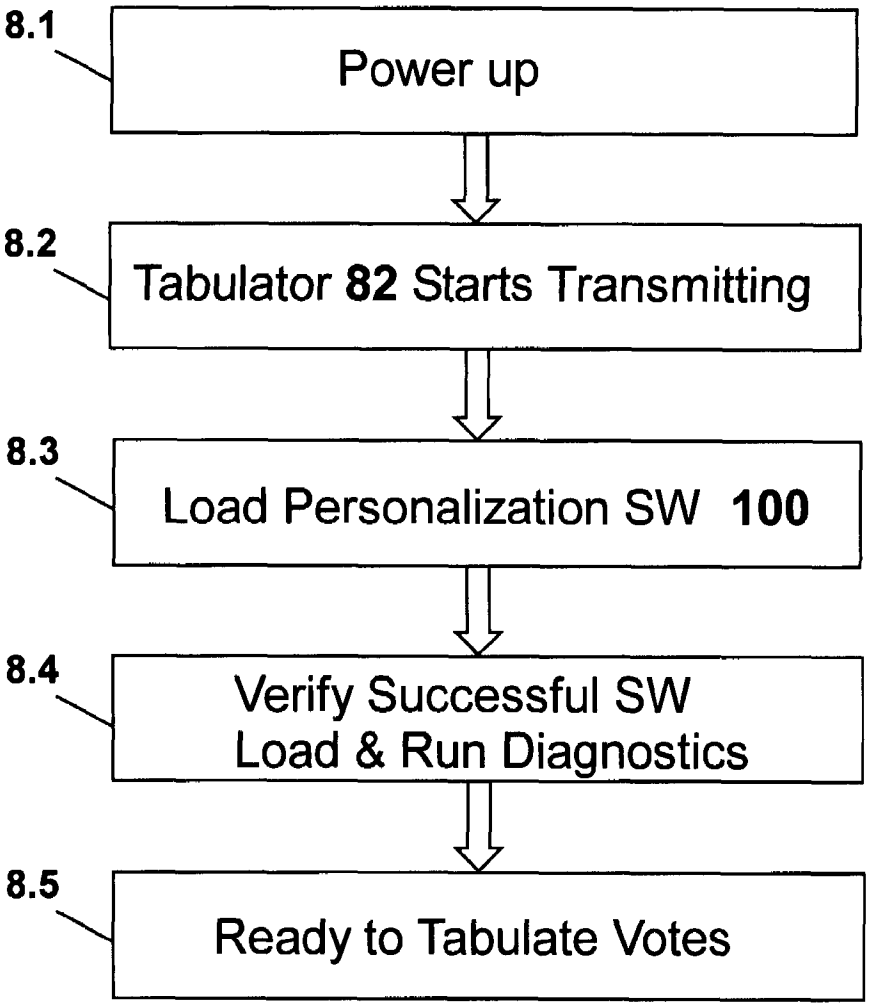
FIG. 8 Tabulator: Pre-Election Flow

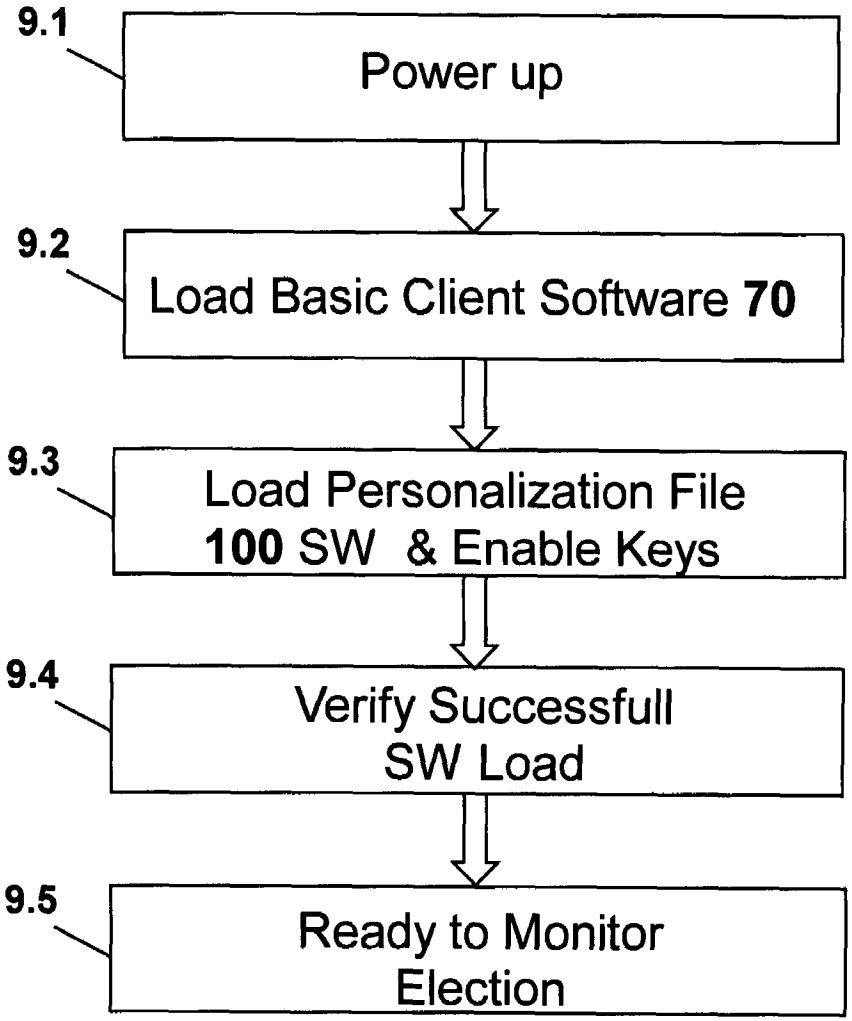
FIG. 9 Client Receiver: Pre-Election

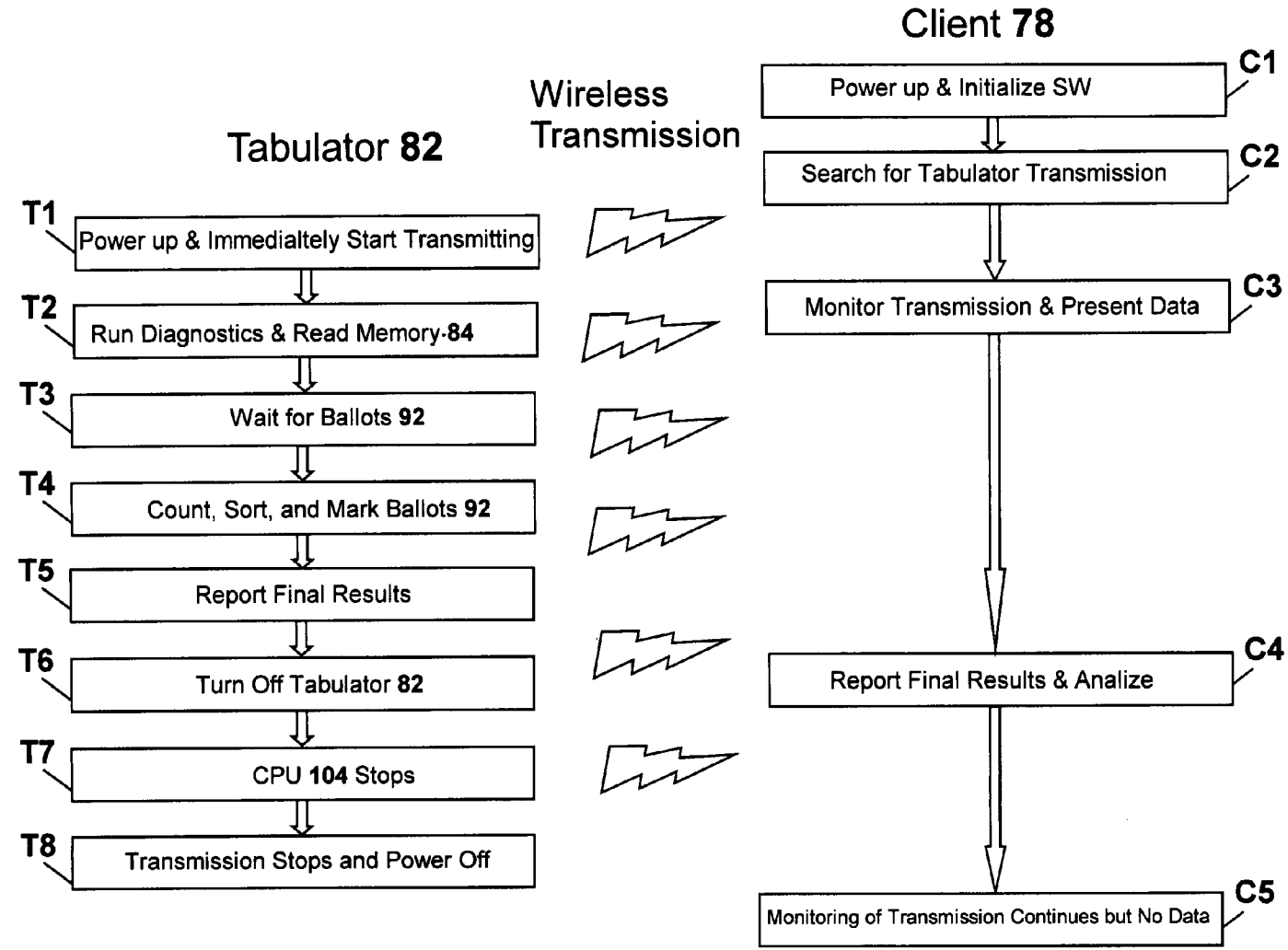
FIG. 10 Transparent System: Election Day

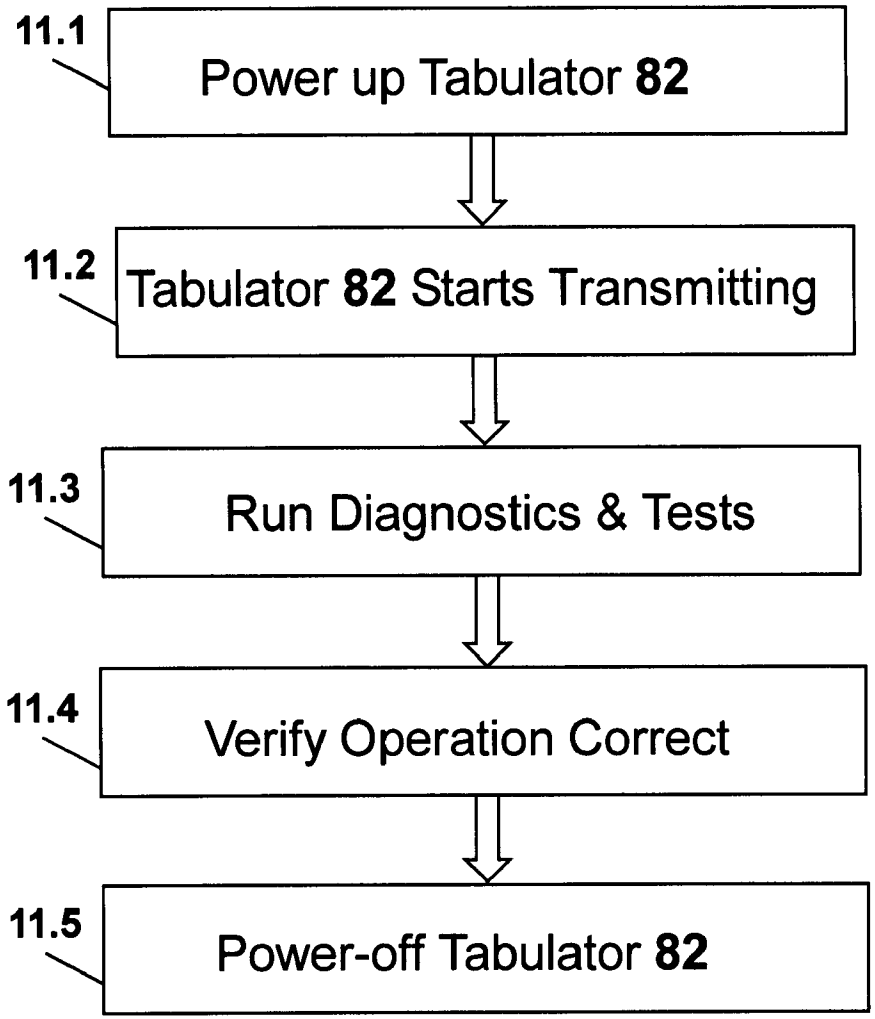
FIG. 11 Tabulator: Post-Election Flow

METHOD AND SYSTEM FOR TRANSPARENT AND SECURE VOTE TABULATION

RELATED APPLICATIONS

This patent application is a Continuation to U.S. Provisional Patent Application No. 60/656,208 filed on Feb. 24, 2005 and claims the benefit of the priority date of that U.S. patent application Ser. No. 60/656,208. In addition, this Patent Application is also a Continuation to U.S. Provisional Patent Application No. 60/663,513 filed on Mar. 18, 2005 and claims the benefit of the priority date of that U.S. patent application Ser. No. 60/663,513. The aforementioned U.S. Provisional Patent Application No.'s 60/656,208 and 60/663,513 hereby incorporated in their entirety and for all purposes in this patent application.

FIELD OF THE INVENTION

The Present Invention relates to automated systems and methods for tabulating and reporting data. More particularly, the Present Invention relates to methods and systems for providing transparency of computational systems processing, such as vote tabulation aspects of elections.

BACKGROUND OF THE INVENTION

The integrity of certain processes managed or controlled by means of information technology systems are of great concern to one or more associations, societies, governments, or polities. For example, compliance with laws or regulations governing the control of elections, nuclear materials handling and other vital activities can be better assured by enabling visibility into the functioning of an information technology system that executes the relevant vital activity.

As one example, the public's sense of the legitimacy of a democratically elected government is significantly related to the electorate's confidence in the integrity of the voting and vote tabulation processes. The application of automated vote tabulating systems can raise questions in the public mind concerning the security of the vote tabulation process from defective tabulation systems, fraudulent activities by election officials and data corruption by third party software hackers. The Prior Art attempts to address these concerns by offering paper trails of each ballot cast and/or assurances and demonstrations of the robustness of the electronic voting system. Yet the public is primarily concerned with how the automated vote tabulation systems actually function during the certified voting process. The Prior Art fails to provide members of the public, press, or electorate a means or method to monitor the actual computational operation of an automated tabulating system during a reading of ballots and a derivative tabulation of votes in an electoral activity.

The public and the electorate are denied access to the real-time operation of Prior Art electronic vote tabulators during a certified vote counting period. Yet certain Prior Art vote automated tabulators contain bi-directional modems that are configured to communicate with via a telephone system, such as a land-line system, a cable based telephone system and/or a telephone system comprising wireless telephony devices. In addition, certain electronic vote tabulators of the Prior Art are vulnerable not only to machine failures, but may also be a target of unauthorized and illegal manipulation attempts by third party software hackers. The public has no generally available way to resolve a suspicion of inaccurate vote tabulation due to either tabulation system malfunction or intentional vote fraud. The common effects of widespread doubt of the integrity of an election process include increased instability of the populace, the exacerbation of social tensions and loss of confidence in the capital markets. The value of providing methods and systems that provide commonly available verification of vote tabulations systems may include immediate economic advantages to the polity and society affected by an election.

It is, therefore, a long-felt need to provide a method to increase the transparency of the operation of an information technology system that at least partially determines the governance and/or execution of a socially significant activity, such as the operation of a nuclear reactor or the implementation of an automated vote tabulation system during an election process.

SUMMARY OF THE INVENTION

Towards this object, and other objects that will become obvious in light of the Prior Art and the present disclosure, the Method of the Present Invention provides a method and system to increase the transparency of the operation of an information technology system. In certain alternate preferred embodiments of the Method of the Present Invention information harvested from the operation of a computational engine is read into a monitor, where the monitor provides at least some of the harvested information via a landline and/or a wireless transmitter to a remote receiver and/or a web server. Where information originated from the computational engine is communicated to a web server, the web server makes available on a website, or via the Internet, representations of the communicated information. The web server may optionally additionally or alternatively provide representations of secondary information available via the Internet, where the secondary information is derived at least partly on the basis of the information received by the web server from the monitor.

In a first preferred voting system embodiment of the Method of the Present Invention, a vote tabulation system is provided, the vote tabulation system having a ballot reader, a tabulator, a monitor, a transmitter, an input module and an output module. The ballot reader examines a plurality of ballots and communicates the pattern of indications detected on each ballot to the tabulator in one or more electronic messages. The tabulator, a computational engine having a central processing unit (hereafter "CPU"), receives electronic messages from the ballot reader and translates the pattern of indications as vote selections in the context of a pre-programmed matrix or configuration of vote categories. The tabulator may optionally be configured to transfer one or more ballots into a specific bin or storage location according to one or more of the characteristics of the ballot. The sort categories of the ballots may include Normal, Absentee, Provisional, Damaged, Error, Questioned Ballot, Spoiled, Blank, Demonstration, and Outstacked. The transmitter is communicatively coupled with the tabulator and receives the tabulator digital electronic values generated relevant to the operation of the vote tabulation system. The digital electronic values of the vote tabulation system are read into a memory of monitor (1) broadcast via the monitor in a radio frequency or other suitable wireless transmission medium or technique known in the art, and/or (2) transmitted via a landline of a telephony network or other suitable electronic communications network or computer network known in the art. The input and output modules of the vote tabulation system are communicatively coupled with the CPU of the tabulator. The input module is used by an on-site or remote operator to program, or otherwise direct the operation of, the tabulator.

The output module is used to communicate information to the operator, to optionally include information related to the identity, state, activity, history and/or condition of the vote tabulation system.

In certain still alternate preferred embodiments of the Present Invention the transmitter may be unidirectional in providing information read from the tabulator to a receiver. In certain still alternate preferred embodiments of the Present Invention the transmitter may be bidirectional enabled to (a) initiate wireless communications by means of an electronic communications handshaking protocol, (b) provide information read from the tabulator by the monitor to a receiver, and/or (c) receive instructions and optionally data from an external transmitter. The receiver and external transmitter may be integrated into an external client system.

A first preferred voting system embodiment of the Present Invention includes a transparent tabulation system having a computational engine and a monitor. The computational engine includes a CPU, a system memory, an input module and an output module. The computational engine processes data and instructions received from the input module in accordance with a system software stored at least partially in the system memory, and provides all or certain results of CPU processing to the output module. The monitor is communicatively coupled with the computational engine and reads the activity of the computational engine. The monitor may optionally include a single channel or multi-channel wireless transmitter, whereby the history of computational activity of the CPU and/or one or more other elements or processes of the computational engine may be transmitted as a history of the computational activity of the tabulation system for storage as a public rectory. The term public record is defined within this disclosure to include documentation that may be stored for immediate or later disclosure to or access by members of the public. The term public is defined within this disclosure to mean one or more (1) members of a polity, nation, society, and/or or persons delegated or authorized by a governmental or non-governmental organization or department to review or access the history.

In certain other alternate preferred embodiments of the Present Invention the vote tabulation system further comprises a media reader, such as a ballot reader, coupled with the CPU, wherein the media reader translates information read from a medium, such as a paper ballot, into digital data and transmits the digital data to the CPU.

In certain yet alternate preferred embodiments of the Present Invention, the media reader may be configured to translate or detect representations or indications of selections or other information stored on or indicated by aspects or qualities of paper ballots, punched sheets, punched cards, printed media, paper tape, digital media, audio data media, and/or video data storage devices. The media reader may optionally be configured to detect or read information stored on a medium and related to encrypted data, an encrypted message header, biometric data, and/or biometric based encrypted data.

In certain still alternate preferred embodiments of the Present Invention, the computational engine computes a checksum for an element of the computational activity history, and the checksum is then communicated via the monitor as a public rectory.

Certain additional alternate preferred embodiments of the Method of the Present Invention include the steps of (i.) receiving the ballots from the voters with vote selections indicated; (ii.) tabulating the ballots with a computational tabulation system; and (iii.) providing a history of the activity computational tabulation system in tabulating the ballots, "history", as a public rectory.

Certain still other alternate preferred embodiments of the Method of the Present Invention include one or more of the optional steps of (i.) releasing copies of the system software of the computational tabulation system as a public record and/or to members of the public; (ii.) providing system software to the vote tabulation system by means of a removable electronic module, e.g., a PCMCIA card; (iii.) sorting the ballots into one of a plurality of collections on the basis of pre-specified characteristics of the ballot, e.g., each ballot distributed into one of the categories of normal, spoiled or corrected; (iv) providing a basic client software to the public for use in analyzing the history; (v.) releasing an optimized client software that provides at least one additional analytic capability or performance level not provided by the basic client software; and (vi.) providing a schematic of the Present Invention to the public to increase confidence of the integrity of the Method of the Present Invention. The basic or optimized client software may optionally be provided on a free, paid license, and/or fee-per-use bases in various alternate preferred embodiments of the Method of the Present Invention. The basic client software, the optimized client software and/or the history may be provided to the vote tabulation system and/or released to the public in an encrypted format. The method used for encrypting the history may perform the encryption at least partially in view of information derived from a personality file of a selected election.

In certain yet other alternate preferred embodiments of the Method of the Present Invention a checksum is generated by the computational tabulation system on the basis of at least part of the history. The checksum may be communicated in association with the history and as public rectory. The Method of the Present Invention may optionally further comprise generating a plurality of unique session records, where each unique session record is associated with a reading of an individual ballot by a ballot reader. One or more unique session records may optionally be associated with (1.) a unique serial number, (2.) a time date stamp, and/or (3.) a marking on the ballot.

Certain still additional alternate preferred embodiment of the Method of the Present Invention includes providing as public record a history of each of a plurality of automated vote tabulators, where the history comprises (1) a substantially complete copy of a system software of each vote tabulator, (2) substantially all data and information input and output of each vote tabulator instantiated during the vote counting, (3) a record of the substantive computational activity of each vote tabulator instantiated during the vote counting, and (4) a computational result of the vote processing of each vote tabulator.

It is understood that in certain additional preferred embodiments of the Method of the Present Invention access to and/or availability of the record of operations of one or more tabulation systems of an election may be limited to specified individuals, or permitted upon a showing of cause, or delayed in time. The foregoing and other objects, features and advantages will be apparent from the following description of the preferred embodiment of the invention as illustrated in the accompanying drawings.

BRIEF DESCRIPTION OF THE DRAWINGS

These, and further features of the invention, may be better understood with reference to the accompanying specification and drawings depicting the preferred embodiment, in which:

FIG. A is a schematic of a computing system provided by a preferred embodiment of the Method of the Present Invention;

FIG. B is a schematic of a monitor of the computing system of FIG A;

FIG. C is a schematic of a remote receiver of the computing system of FIG A;

FIG. D is a flow chart of a first preferred embodiment of the system software that that may be executed by a computational engine of the computing system of Figures A and B and in accordance with certain alternate preferred embodiments of the Method of the Present Invention;

FIG. E is a diagram of the format of a message M of the first preferred method of the system software of FIG. D.

Figure 2A:
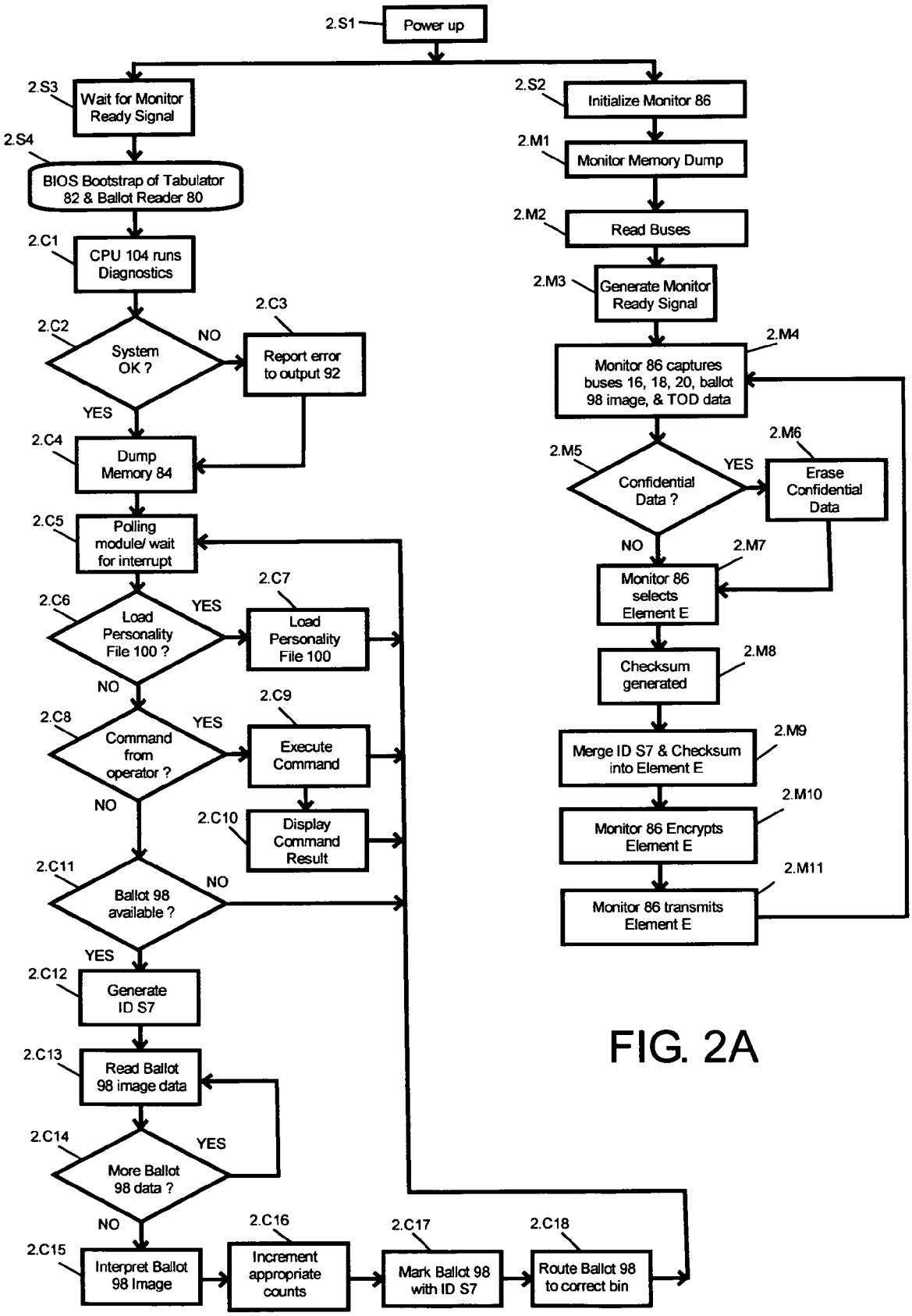
Figure 6A:
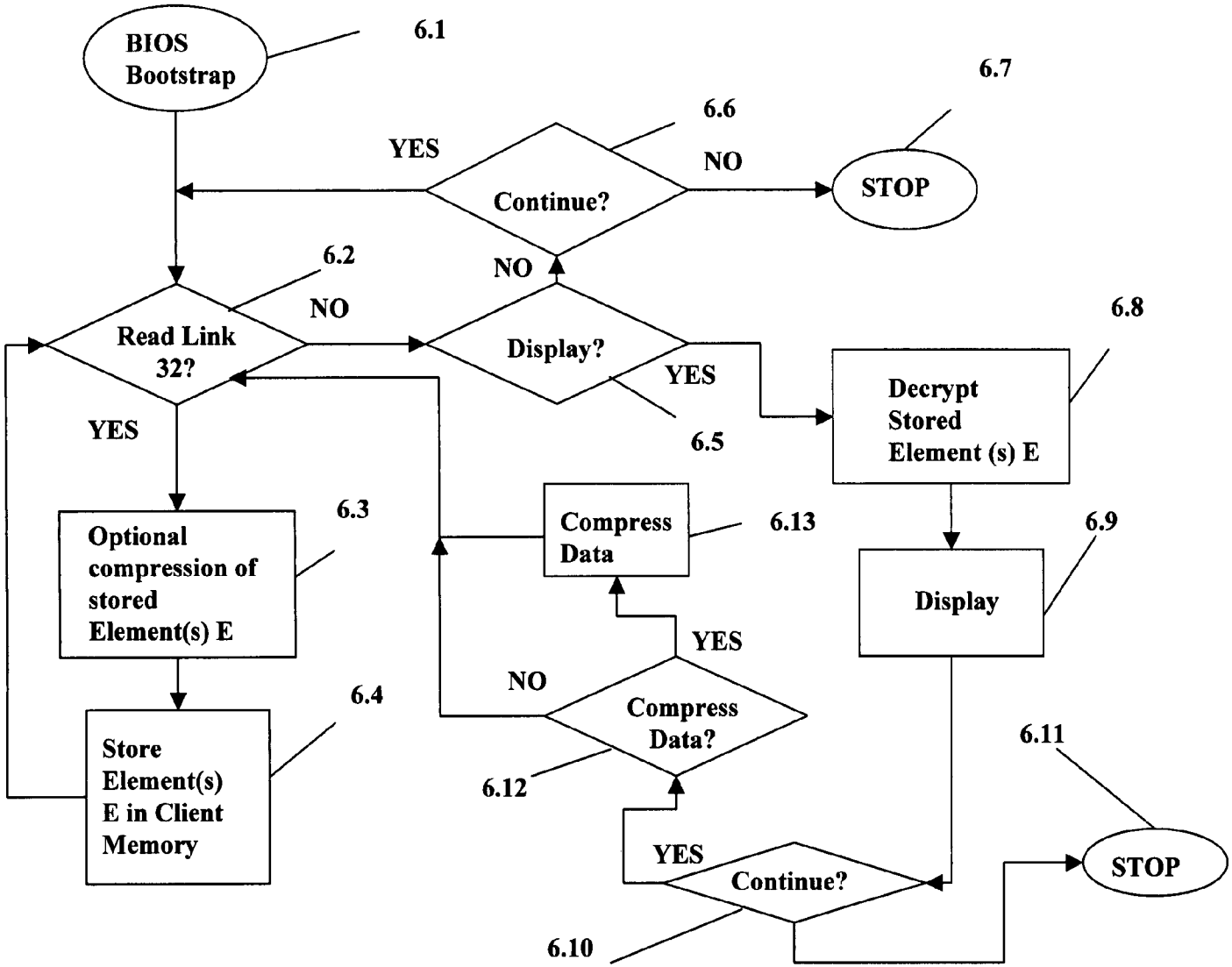

FIG. F is a flow chart of a first preferred embodiment of the client software of FIG. C that that may be executed by a client receiver of the computing system of FIG. A and in accordance with certain alternate preferred embodiments of the Method of the Present Invention;

FIG. G is a flow chart of a second preferred embodiment of the system software that that may be executed by a computational engine of the computing system of Figures A and B and in accordance with certain alternate preferred embodiments of the Method of the Present Invention;

FIG. H is a flow chart of a second preferred embodiment of the client software of FIG. C that that may be executed by a client receiver of the computing system of FIG. A and in accordance with certain alternate preferred embodiments of the Method of the Present Invention;

FIG. 1 is a schematic of a first preferred embodiment of the Present Invention, or first version, and including a client receiver;

FIG. 2 is a schematic of the tabulator, ballot reader and monitor of the vote tabulation system of FIG. 1;

FIG. 2A is a software flowchart of a system software tabulator, ballot reader and monitor of the first version of FIGS. 1 and 2;

FIG. 3 is a an element of a session record as stored in the monitor of FIGS. 1 and 2;

FIG. 4 is a plurality of session record elements that comprise information received from a same ballot of FIG. 1;

FIG. 5 is a schematic of a plurality of client receivers of FIG. 1 and alternate or optional client transceivers in combination with the vote tabulation system of FIG. 1;

FIG. 6 is a schematic of a client receiver of FIG. 1 shown having an optional or alternate configuration as a client transceiver;

FIG. 6A is a software flowchart of a client software of the remote client receiver of FIG. 6;

FIG. 7 is a process diagram of the operational phases of the first version of FIG. 1;

FIG. 8 is a process diagram of the pre-election operational phase of a vote tabulator of the vote tabulation system of FIGS. 1 and 2;

FIG. 9 is a process diagram of the pre-election operational phase of the client receiver of the first version of FIG. 1 or the client transceiver of FIGS. 5 and 6; and FIG. 10 is a process diagram of the operations of the vote tabulation system of FIG. 1 during and proximate to an election.

FIG. 11 is a process diagram of the post-election operational process of a vote tabulator of the vote tabulation system of FIG. 1.

DETAILED DESCRIPTION OF THE PREFERRED EMBODIMENT

The following description is provided to enable any person skilled in the art to make and use the invention and sets forth the best modes contemplated by the inventor of carrying out his or her invention. Various modifications, however, will remain readily apparent to those skilled in the art, since the generic principles of the Present Invention have been defined herein.

Referring now generally to the Figures and particularly to FIG. A, FIG. A is a schematic of a computing system 2 (hereafter "first system 2") provided by a preferred embodiment of the Method of the Present Invention. The first system 2 includes a computational system 3 and a client receiver 4. The computational system 3 includes a computational engine 5, a monitor 6, a monitor BIOS circuit 7, a system BIOS circuit 8, client receiver 4, and an optional media reader 10. The monitor BIOS circuit 7 comprises a logic circuit that, when the computing system 3 is powered up the monitor BIOS circuit 7 boots up the monitor 6 and provides basic input and output instructions that initiate the operation of the monitor 6. The system BIOS circuit 8 comprises a logic circuit that, when powered up and after receiving a ready signal from the monitor 6, boots up the computational system 3 and provides basic input and output instructions that initiate the operation of the computational system 3. A CPU 12, system memory 14, a time of day clock 15 (hereafter "TOD 15"), and optional system resources A through N of the computational engine 5 communicate generally via an Address Bus 16, Data Bus 18, and a plurality of Control and Status Lines 20. The TOD 15 is the system clock of the computational system 3 and provides the clock cycle synchronization signal to the vote computational system 3, to include the computational engine 5, the monitor 6, and the optional media reader 10. The media reader 10 may alternatively or additionally be communicatively coupled with the CPU 12 via a Bypass Link 22. The ready signal is issued by the monitor 6 after the monitor 6 begins reading the Address Bus 16, Data Bus 18, and a plurality of Control & Status Lines 20, and the Bypass Link 22. A system software program 24 (hereafter "system software 24") of the first computational system 3 may reside wholly or partly in the system memory 14, and/or an optional hardware memory card 26 of Resource A. It is understood that the system software 24 controls and directs the operation of the computational engine 5 and the media reader 10. In addition, a monitor software 27 directs and controls the operation of the monitor 6. The monitor software 27 may reside in a monitor memory 28, and/or in one or more additional or alternate memories of the first system 2, and as discusses below in reference to FIG. B. The flow of the system software 24 and the monitor software 27 of the computational engine 3 are provided in FIG. D below. The monitor memory 28 is communicatively coupled to the Address Bus 16, Data Bus 18, and the plurality of Control and Status Lines 20 and one or more Bypass Links 22 of the computational engine, and reads values placed on Address Bus 16, Data Bus 18, and the plurality of Control and Status Lines 20 and one or more Bypass Links 22 at every TOD 15 generated clock cycle. A data selector 30 of the monitor 6 reads the addresses, data, status and control line signals (hereafter "operational data") from the Address Bus 16, Data Bus 18, and the plurality of Control and Status Lines 20 via the monitor memory 28, selects and formats operational information read by the monitor memory 28 in a same clock cycle into a monitor message M (as per FIG. E), and communicates the monitor message M to the client receiver 4 via a client communications link 32. The data selector 30 may also additionally be communicatively coupled to the Bypass Link 22 and read electronic messages form the Bypass Link 22 sent between the CPU 12 and the media reader 10. The content of electronic messages read by the data selector from the Bypass Link 22 is included in the definition of the term "operational data" in this disclosure. The client receiver 4 stores the selected operational information in a client memory 34. The public, or at least a plurality of members of the public, may later access or view the operational information by means of an output module 36 of the client receiver 4, whereby a partial or complete history of the operation of the computational engine 5 may be examined and reviewed by a plurality of the public. The output module 36 may be or comprise a video monitor or other suitable information display device.

The data selector 30 may be configured to provide the selected operational information to a web server 38 via the Internet 40. The web server 38 is communicatively coupled with the Internet 40 and provides the operational information for public review on a plurality of network computers 42.

The monitor 6 may be configured to communicate the selected information to the client receiver 4 by means of one or more suitable communications systems and techniques known in the art, where the client communication link 32 may be or comprise a landline, an electronics communications network, the Internet 40, a pair of tuned wireless communications modules configured for unidirectional or bidirectional wireless communications, or by transfer of a memory device, e.g., a memory card.

Resource A is configured to read software encoded instructions of a personality file 44 from the removable hardware memory card 26 and communicate, provide or make accessible the software encoded instructions of the personality file 44 to the CPU 12 via the Address Bus 16, Data Bus 18, and a plurality of Control and Status Lines 20.

FIG. B is a detailed drawing of the monitor data selector 30. A combinational logic 45 communicates with the monitor memory 28, a selector random access memory 46, a selector read only memory 48, a firmware 50, a hardware logic circuitry 52, a monitor checksum generator 54 and the client communications link 32 over a Monitor Communications Bus 56. The combinational logic 45 may be a programmable hardware logic circuit, or a firmware, or field programmable logic, or a microprocessor, or other suitable logic device known in the art. The monitor software 27 may be stored in and read from the combinational logic 45, the monitor memory 28, the selector random access memory 46, the selector read only memory 48, the firmware 50, and/or the hardware logic circuitry 52. In certain alternate preferred embodiments of the Method of the Present Invention the system memory 14 (as per FIG. A), the monitor memory 28, the random access selector memory 46, the read only selector memory 48, the firmware 50, and/or the hardware logic circuitry 52 may be configured to temporarily or permanently store some or all of the system software 24. In various alternate preferred embodiments of the Method of the Present Invention one or more system resources A through N, the system memory 14, the removable memory card 26, the monitor memory 28, the random access selector memory 46, the read only selector memory 48, the firmware 50, and/or the hardware logic circuitry 52 may be configured and employed to execute suitable encryption and decryption techniques known in the art of at least some of the operational data selected for communication to the client receiver 4.

FIG. C is a schematic of the client receiver 4 of FIG. A. A client CPU 58, the client memory 34, the client output module 36, a client BIOS circuit 59, a hardware memory card interface 60, a client input module 62, a client personality memory card 64, a client Internet access circuit 65, an encryption/decryption logic 66 and the client communications link 32 communicate over a Client Communications Bus 68. The client BIOS circuit 59 bootstraps and initializes the client receiver 4 upon power up of the client receiver 4. The client receiver 4 operates in accordance with a client software 70 and a client personality file 72. A user communicates with the client receiver 4 by means of the client input module 62, and the user reviews operational data communicated from the monitor 6 via the output module 36. The client input module 62 may be or comprise an electronic or electrical keyboard, or other suitable man/machine interface known in the art. The client output module 36 may be or comprise a video display system or other suitable information output device or system known in the art.

Referring now generally to the Figures and particularly to FIG. D, FIG. D is a flow chart of a first preferred embodiment of the system software 24 and monitor software 27 that that may be executed by the computational system 3 of the first system 2. The steps denoted with a "DC" prefix are steps of the system software 24 and the steps denoted with a "DM" prefix are steps of monitor system software 27. In step D.0 the computational system 3 is powered up, to include the monitor BIOS circuit 7 and the system BIOS circuit 8. In step D.1 the monitor BIOS circuit 7 bootstraps and initializes the monitor 6. In step DM.1 of the monitor software 27 performs a memory dump of the monitor 6 and communicates the contents to the client receiver 4 of all or some of the memory circuits of the monitor 6, to include some or all of the contents of one or more memory circuits of the combinational logic 45, the monitor memory 28, the selector random access memory 46, the selector read only memory 48, the firmware 50, the hardware logic circuitry 52, and the monitor checksum generator 54. In step DM.2 the monitor memory 28 reading information presented on the Address Bus 16, the Data Bus 18, the Control & Status Lines 20, and the Bypass Link 22 at each clock cycle of TOD 15, and stores the information for access by the selector 30. In step DM.3 the monitor 6 issues a ready signal to the system BIOS circuit 8, whereupon the system BIOS circuit 8 initiates bootstrapping of the computational engine 5 and the media reader 10. More particularly, prior to step D.2 the system BIOS circuit 8 waits until the ready signal is received via the Control and Status Lines 20, and then initiates and completes a bootstrapping of the computational engine 5 and the media reader 10 in step D.3. In step DC.1 the system software 24 performs a memory dump of some or all of the contents of one or more addresses memories of the computational engine 5 and the media reader 10 by placing the contents and addresses of these selected memory locations on the Address Bus 16, the Data Bus 18, Control & Status Lines 20, and the Bypass Circuit 22, wherefrom the monitor memory 28 reads the selected data, addresses and communicated values. In step DC.2 the computational engine 5 generates and begins to execute the next step of system software 24. In step DC.3 the computational engine 5 and the media reader 10 place data, addresses and other values on the Address Bus 16, the Data Bus 18, Control & Status Lines 20, and the Bypass Circuit 22, in accordance with the instruction began in step DC.2. In step DC.4 the system software 24 directs whether the computational engine 5 shall proceed back to step DC.2 and generate and execute another instruction, or to end operation by as per step DC.5. Substantively concomitant with the execution of the system software 24, the monitor software 27 directs the monitor 6 to read operational information (at each successive clock cycle of the TOD 15) from the Data Bus 18, the Address Bus 16, the Control & Status Lines 10, and the Bypass Link 22, store the read operational information in the monitor memory 28, write the operational information stored in the monitor memory into the data selector 30, format the operational information read by the data selector 30 into monitor message M, and communicate the monitor message M to the client receiver 4 via the client communications link 32. More particularly, in step DM.4 operational information stored in the monitor memory 28 is written into the data selector 30. In step DM.5 the data selector 30 formats, as per FIG. E, one or more monitor message M wherein each monitor message M contains operational data read in a same clock cycle by the monitor memory 28. The message(s) formed in step DM.5 are the communicated to the client receiver 4 in step DM.6 via the client communications link 32. The monitor software 27 directs the data selector in step DM.7 to move from step DM.7 to either (i.) step DM.8 and cease operations, or (ii.) step DM.9 to read the operational information made available to the monitor memory 28 in the next succeeding clock cycle, as generated by the TOD 15, substantially simultaneously from the Address Bus 16, Data Bus 18, Control & Status Lines 20, and the Bypass Link 22. From step DM.9 the monitor software 27 proceeds back to step DM.4 and to write the operational values captured in step DM.9 into the data selector 30 for formatting into a monitor message M in step DM.5 and then communication to the client receiver 4 in step DM.6.

Referring now generally to the Figures and particularly to FIG. E, FIG. E is a format diagram of the monitor message M. Message M includes operational data M1-M4 read in a same clock cycle of the TOD 15 from the Address Bus 16, Data Bus 18, Control & Status Lines 20, and the Bypass Link 22. A time-date stamp value of the same clock cycle is stored in a clock cycle field M0. The values of the Address Bus 16 read by the monitor memory 28 during the clock cycle indicated or referenced by the time-date stamp value recorded in field M0 are stored in the address field M1. The values of the Data Bus 18 read by the monitor memory 28 during the clock cycle indicated or referenced by the time-date stamp value recorded in field M0 are stored in the address field M2. The values of the Control & Status Lines 20 read by the monitor memory 28 during the clock cycle indicated or referenced by the time-date stamp value recorded in field M0 are stored in the address field M3. The values of the Bypass Link 22 read by the monitor memory 28 during the clock cycle indicated or referenced by the time-date stamp value recorded in field M0 are stored in the address field M4. An optional field M5 includes a checksum of operational information generated by the checksum generator 54 and based upon the operational information stored in one or more fields selected from the group of fields comprising M1, M2, M3 and M4.

Referring now generally to the Figures and particularly to FIG. F, FIG. F is a flowchart of a first preferred embodiment of the software flow of the client receiver 4. In step F.0 the receiver client 4 is powered up and then bootstrapped in step F.1 by the client bootstrap circuit 59. In step FC.1 the client receiver polls the client communications link 32 to determine if a message M is available for receipt. The client receiver 4 will, if there is a message M available, read the message M from the client communications link 32 in step FC.2, and then store the message M in the client memory 34. If there is no message M to receive, or after the execution of receipt and storage of a message M in steps FC.2 and FC.3, the client receiver 4 determines in step FC.4 if there has been any input of a command or a request from the input module 62. If a command or request is detected in step FC.4, then the client receiver 4 responds to the request in step FC.5. The client receiver 4 proceeds on to step FC.6 from either step FC.4 and FC.5, wherein the client receiver 4 determines in step FC.6 whether the client receiver shall power down by proceeding onto step FC.7. If the client receiver 4 does not execute step FC.7, then the client receiver 4 returns to step FC.1 and again examines the client communications link to observe whether there is a message M available for receipt by the client receiver 4.

Referring now generally to the Figures and particularly to FIG. G, FIG. G is a flow chart of a second preferred embodiment of the system software 24 and monitor software 27 that that may be executed by the computational system 3 of the first system 2. In step G.0 the monitor 6 is booted up to run monitor software 27 by the system BIOS circuit 7. After the monitor is booted and enabled to read the Address Bus 16, Data Bus 18, the Status & Control Lines 20 and the Bypass Link 22, the system BIOS circuit 8 boots up the computational engine 5 and the media reader 10. The computational engine 3 begins to run system software 24 after boot up, wherein the system software 24 may be at least partially stored in, and made accessible to the CPU 12 from, the system memory 14, and/or partially provided from the hardware memory card 26 of Resource A. Resource A is configured to communicatively couple with the CPU 12 and the hardware memory card 26 and other suitable memory devices that store and make accessible software encoded instructions, e.g., a PCMCIA card. It is understood that the term "software encoded instructions" is defined to include software encoded instructions and data useful or needed in executing a software program or step of a software program. The hardware memory card 26 may alternatively or additionally provide the personality file 44 to the computational engine 5, wherein the personality file 44 affects the flow of the system software and directs the system software to function or to perform in accordance with a certain scenario, such as a particular election or system audit. The system software 24 directs the computational engine 5 and the media reader 10 in step G.2 to perform a memory dump via the Address Bus 16, the Data Bus 18, the Control & Status Bus 20, and the Bypass Link 22. The monitor memory 28 reads the operational information passing over the Address Bus 16, the Data Bus 18, the Control & Status Bus 20, and the Bypass Link 22 during the memory dump of step G.2 and communicates the operational information related to the memory dump of step G.2 to the data selector 30. The data selector 30 then formats the operational information related to the memory dump of step G.2 into message M's and makes the message M's available to the client receiver 4 via the communications link 32. In optional step G.3 software encoded instructions of the personality file 44 are read by the computational engine 5 and the system software 24 incorporates the relevant software encoded instructions of the personality file 44 stored in the removable hardware memory card 26 into the flow of the system software 24. In step G.4 operational data is communicated to and from the CPU 12 and the system memory 14, and optional system resources A through N of the computational engine by means of the Address Bus 16, the Data Bus 18 and the Control and Status Lines 20. In optional step G.5 the computational engine 5 receives information from the optional media reader 10 by means of the Address Bus 16, the Data Bus 18 and the Control and Status Lines 20, and alternately or additionally by the Bypass Link 22. The media reader 10 may be or comprise a ballot reader, a sensor, a memory device, an optical disk reader, or other suitable data generating or data reading device known in the art. In step G.6 the monitor memory 28 reads operational data from the Address Bus 16, Data Bus 18, and/or Control and Status Lines 20 and provides the operational data to the data selector 30. In step G.7 the data selector 30 selects information from the monitor memory 28 and includes and formats the selected operational information into elements E of session records R, as per FIGS. 3 and 4 below. In optional step G.8 the element E is examined to determine if any operational information is prohibited, as identified by the software encoded instructions of the system software and/or the software encoded instructions of the personality file 44. Operational information that is determined to be prohibited for transmission via the monitor 6 in step G.8 is then removed in step G.9. The session element E is encrypted in optional step G.10 by means of the monitor memory 28, the random access selector memory 46, the read only selector memory 48, the firmware 50, and/or the hardware logic circuitry 52 applying or directing a suitable encryption method and/or system known in the art. In step G.11 the data selector 30 communicates the session record elements E to the client receiver 4 via the client communications link 32 of the first system 2. In step G.12 the monitor software 27 determines if there are more Elements E in the monitor memory 28 in process to be read by the data selector 30. If the monitor memory 28 has operational information available or in process to be read by the data selector 30 proximate to the execution of step G.12, the first system 2 proceeds to execute step G.6. If the monitor memory 28 does not have operational information available to be read by the data selector 30, the first system 2 proceeds on to execute step G.13. In step G.13 the first system 2 is directed by the system software 24 to either proceed to step G.14 and halt, or to execute step G.4. In the execution of step G.14 the computational engine 3 ceases operation after which the monitor 6 ceases transmitting operational information.

Referring now generally to the Figures and particularly to FIG. H, FIG. H is a software flowchart of the client software 70 that can be executed by the client receiver 4. In step H.1 the client receiver 4 is booted up. In optional step H.2 the client personality file 72 stored on the client personality memory card 64 is read via the Client Communications Bus 68 and software encoded instructions of the client personality file 72 are incorporated into the client software 70. The client personality file 72 may be communicated to the remote client receiver via the Internet 40 and the client Internet access circuit 65. As one example, the personality file may provide one or more decryption keys for use in decrypting session records that had been encrypted by the monitor 6. As another example, the client personality file 72 may inform the client receiver 4 that the client receiver 4 is authorized to run the system software as a basic client software, or as an optimized client software. Advantages of the optimized client software over the basic client software may include (a) expedited access by the user of the client receiver 4 to the session records R stored in the client memory 34 as compared with slower performance of the client receiver 4 as authorized by the basic client software, or (b) visual graphic display capabilities of mathematical analyses of the session records R via the output module 36 as the client receiver 4 is authorized by the optimized client software. In step H.3 the client communications link 32 is queried to determine if an element E or a session record R is ready to be communicate. If the client receiver 4 determines in step H.3 that client communications link 32 is communicating an element E or a record R, then the client communications link 32 is read in step H.4. In optional step H.5 the element E or record R is decrypted by the application of a suitable decryption technique known in the art, and optionally with the direction by or use of the client memory 34, the client personality memory card 64 and/or encryption/decryption logic 66. In step H.6 the element E or record R is stored in the client system memory 34. The client software 70 directs the client receiver 4 to proceed from step H.6 to step H.7, where the client receiver 4 determines if a request or command to display one or more elements E or records R has been received by the client CPU 58. Step H.8 is executed if the client software 70 has detected a request or command to display or communicate elements E or records R stored in the client system memory 34. The requested elements E and records R may be displayed by or communicated to the client output module 36 and/or written into the removable client personality memory card 64 in step H.8. Alternatively or additionally the requested elements E and records R may be communicated to the web server 38 for display on the plurality of network computers 42. Requests and commands to display or communicate elements E or records R may optionally be issued by, originated at, or read from the client input module 62, the client personality file 72, and/or the client communications link 32. In one example of an instantiation of step H.8, a member of the public would request, via the client input module 62, access to the session record elements E stored in the client memory 34, i.e., the complete or partial history of the operation of the computational engine 5 that is stored in the client memory 34. The client receiver 4 proceeds from either step H.7 or H.8 to step H.9, wherein the system software determines if the client receiver shall stop reading or writing elements E and records R. The client receiver 4 will then execute either (1) step H.10 and halt reading and writing, or (2) step H.11. In step H.11 the client software 70 determines if the client CPU 58 shall proceed on to execute either step H.3 or step H.7.

Referring now generally to the Figures, and particularly to FIG. 1, FIG. 1 is a schematic of a first preferred embodiment of the Present Invention 73 (hereafter "first version 73"). The first version 73 comprises a vote tabulation system 74 and a remote client receiver 78. The vote tabulation system 74 includes a ballot module 80, a tabulator computational system 82 having a tabulator memory 84, a system monitor and data assembler 86, a transmitter 88, an input module 90, an output module 92, a channel select module 94, and an optional telephone modem 96. The telephone modem 96 is or comprises a link to a telephone network (not shown). The transmitter 88 and the remote client receiver 78 may alternatively be configured to an enable bidirectional communications between the vote tabulation system 74 and the remote client receiver 78, as per FIG. 6 below. An authorized election worker (hereafter "operator") uses the input module 90 to direct the operation of the first version 73 in accordance with a system software 93 of the first version 73, a monitor software 99, and a software encoded election personality file 100 related to an election, as per the flowchart of FIG. 2A. The election personality file 100 might direct the system software 93 to reserve certain memory addresses of the memory 84 as dedicated to counting votes, for example, as the running total of votes (1) for a candidate, (2) for a ballot proposition, or (3) against a ballot proposition. The election personality file 100 may alternatively or additionally direct the a system monitor and data assembler 86 (hereafter "monitor 86") and data assembler 86 to not communicate specific operational information to the remote client 78, such as an encryption key when the encryption key is communicated over the Data Bus 18, or the memory address of the encryption key is presented on the Address Bus 16. The input module 90 may be or comprise an electronic or electric keyboard or other suitable input device known in the art. The system software 93 and the election personality file 100 may be stored within the tabulator memory 84, as further discussed regarding FIG. 2 below. The ballot module 80 examines a plurality of ballots 98 as ballots 98 are input to the ballot module 80. The ballot module 80 also communicates a pattern of indications detected on some or all of the ballots 98 to the tabulator computational system 82 (hereafter "tabulator 82") in an electronic ballot image message. The pattern of indications read by the ballot module 80 may be created by visible marks made on the ballot 98 by a voter, and/or by punches or holes forced into the material of the ballot 98. The ballot module 80 may include an optical sensor that detects the voter caused marks, holes or punches as variations from the optical characteristics of the body of the ballot 98. The tabulator 82 receives electronic messages from the ballot module 80 and translates the information in the electronic ballot image message pattern as indications detected on the ballot 98 by the ballot module 80 as indicating vote selections in the context of a pre-programmed matrix of vote categories, as per software encoded instructions stored on an election-specific personality file 100 ("election personality file 100"), as per FIG. 2A. The tabulator 82 may use suitable hardware and software error prevention, detection and correction modules and techniques known in the art to identify, correct and prevent errors in translating the pattern of indications as vote selections. A time of day clock 102 (hereafter "TOD 102") provides a clock cycle pulse and a time date stamp to the vote tabulation system 74. The system monitor and data assembler 86 (hereafter "monitor 86") provides a time date stamp generated by TOD 102 in session record elements E of FIGS. 3 and 4. In certain preferred alternate preferred embodiments of the Method of the Present Invention the monitor 86 automatically selects a mode or channel, e.g., a radio wave carrier frequency, to transmit messages to the receiver client The channel select 94 enables an operator to select the wireless frequencies and/or modalities that the transmitter 88 communicates with the remote client receiver 78. The first version 73 provides status and system performance information and responds to commands and requests to the operator via the output module 92. The output module 92 may be or comprise a video display system or other suitable information output device or system known in the art. The telephone modem 96 receives operational information generated by the first version and makes the operational information available via a telephony network (not shown).

Referring now generally to the Figures and particularly to FIGS. 1 and 2, FIG. 2 is a schematic of the ballot module 80, tabulator 82 and monitor 86 of the vote tabulation system 74 of FIG. 1. A ballot reader 103 of the ballot module 80 reads the ballot and may report via a ballot image message to the tabulator 82 that a darkened area was observed at an ascertainable location within the ballot 98. The system software 93 translates the significance of a darkened area in identified location of the ballot 98 as informed by the election personality file 100. The software encoded instructions of the personality file 100 might thereby direct the system software 93 to interpret information provided in the electronic ballot image message concerning the darkened area and the location within the ballot 98 of the darkened area as, for example a vote for a certain candidate of a particular elected office, or a vote for or against a ballot proposition. The system software 93 would then increment a vote count stored in a memory location of a tabulator memory 84 (as per FIG. 2) of the first version 73, thereby crediting the candidate for the elected office with receiving one vote or the ballot proposition as receiving one yea or one no vote, as directed by the election personality file. The monitor 86 is communicatively coupled with the tabulator 82 and reads operational data of the vote tabulation system 74 from the Address Bus 16, the Data Bus 18, and the Status and Control Lines 20, and from the optional Bypass Link 22. The monitor 86 observes the operation of a CPU 104 of the tabulator 82 by reading the inputs and outputs of the CPU 104 communicated via the Address Bus 16, the Data bus 18 and the Control and Status Lines 20. The operational information as read into a monitor memory 106, formatted in a monitor data selector 108, and is then transmitted (1) via a radio wave or other suitable wireless transmission medium known in the art via the transmitter 88 and/or via the telephone modem 96 to an electronics communications network, such as a telephony network. The input module 90 and the output module 92 of the vote tabulation system 74 are communicatively coupled with the CPU 104 of the tabulator 82. The input module 90 is used by an on-site operator, or by a remote operator, to program, or otherwise direct the operation of, the tabulator 82. The output module 92 is used to communicate information to the operator related to the state, activity and condition of the vote tabulation system 74.

The ballot module 80 of the first version 73 may optionally be configured with a ballot marker 112 that marks ballots 98 with a ballot identification number where the ballot identification number may comprise, or may be partially derived from, a date time stamp originated by the time of day clock 102. The ballot module 80 may additionally or alternatively comprise a ballot router 114 that transfers each ballot 98 into a specific bin 116 according to one or more of the characteristics of the ballot 98 detected by the ballot module 80. The sort categories of the ballots 98 may include Normal, Absentee, Provisional, Damaged, Error, Questioned Ballot, Spoiled, Blank, Demonstration, and Outstacked. These ballot categories may be defined in the suitable ballot categories known in the art, such as:

- Normal Ballot—an acceptable ballot with indicated votes;
- Absentee Ballot—a ballot from an absentee voter;
- Provisional Ballot—a ballot from an individual who's right to vote has not yet been verified;
- Damaged Ballot—a ballot that is bent, torn or otherwise damaged;
- Error Ballot—example/test ballot with error conditions (e.g., overvotes);
- Questioned Ballot—ballot that is associated with a particular individual;
- Spoiled Ballot—a ballot that has been returned by a voter for another ballot because of an error the voter made;
- Blank Ballot—a ballot with no detected voter made indications;
- Demonstration Ballot—a ballot used only for demonstration purposes; and
- Outstacked Ballot—a ballot that has not been read/counted and is not placed with the counted ballots.

Referring now generally to the Figures and particularly to FIG. 2A, FIG. 2A is a flow chart of a second preferred embodiment of the system software 93 and monitor software 99 that that may be executed by the vote tabulation system 74. The steps denoted with "2.S" are included in the system software 93 and executed prior to bootstrapping the tabulator 82 and the ballot module 80. The steps denoted with a "2.C" prefix are steps of the system software 93 executed by tabulator 82, and the ballot module 80, the input module 90, the output module 92, the TOD 102 and the telephone modem 96. The steps denoted with a "2.M" prefix are steps of monitor system software 99. In step 2.S1 the computational system 3 is powered up. In step 2.S2 monitor BIOS circuit 7 bootstraps and initializes the monitor 86. In step 2.M1 the monitor software 93 performs a memory dump of the monitor 86 and communicates to the client receiver 78 via wireless transmission from the transmitter 88 the contents of all or some of the memory circuits of the monitor 86. In step 2.M2 the monitor memory 106 begins to read and store information presented on the Address Bus 16, Data Bus 18, Control & Status Lines 20, and the Bypass Circuit 22 at each clock cycle of TOD 102. The monitor 86 issues a ready signal in step 2.M3 to direct the system BIOS circuit 8 to bootstrap the tabulator 82 and the ballot module 80. In step 2.M4 the monitor memory 106 reads and stores at each TOD 102 generated clock cycle the values, i.e. operational data, present on the Address Bus 16, the Data Bus 18, the Status and Control Line 20 and the Bypass Link 22. In step 2M.5 the data selector reads operational data from the monitor memory 106 and determines if any content of the operational information is prohibited for transmission from the from the vote tabulation system 74. If prohibited data, e.g., an encryption key, is detected in step 2.M5, the monitor 86 erases the prohibited data in step 2.M6. The monitor proceeds from either step 2.M5 or step 2.M6 to step 2.M7 wherein the monitor formats an element E and populates the element E with the operational information. In step 2.M8 the checksum generator 54 generates a checksum based upon at least part of the operational information of the element E. In step 2.M9 the checksum generated in step 2.M8, a TOD 102, and an identification number are added into the element E. In step 2.M10 the element E is encrypted. The element E is transmitted via the transmitter 88 to the client receiver 78 in step 2.M11. The monitor 86 proceeds on from step 2M.11 to step 2.M4 and therefrom records the operational information and communicates the operational information from the monitor memory 106 to the data selector 108 as per steps 2.M4 through 2.M11.

Referring now generally to the first version 73, and particularly to the system software 93 and the vote tabulation system 74. In step 2.S3 the tabulation system 74 waits to receive the ready signal from the monitor 86 before bootstrapping. In step 2.S4 the system BIOS circuit 8 bootstraps and initializes the tabulator 82 and the ballot module 80. In step 2.C1 the tabulator 82 and/or the ballot module 80 execute diagnostic software. In step 2.C2 the system software 93 evaluates if the vote tabulation system 74 has diagnostic data or error to report. If the system software 93 identifies in step 2.C2 data or errors generated in step 2.C1 to report, CPU 104 issues an error report in step 2.C3 to the output module 92. The system software 93 performs a memory dump in step 2.C4, whereby some or all of the contents of all or selected memory locations of the tabulator memory 84 and other memory locations of the tabulation system 74 are presented on the Address Bus 16, the Data Bus 18, the Control and Status Lines 20, and the Bypass Key 22 for reading by the monitor memory 106, formatting into elements E and transmission to the client receiver 78. Step 2.C4 thereby provides the client receiver 78 with a snapshot of some or all of the values held in some or all of the memory locations of the tabulations system 74 prior to the execution of step 2.C5. The tabulator 82 waits for an interrupt in step 2.C5, wherein the interrupt may be received from, in certain alternate preferred embodiments of the Method of the Present Invention, the interrupt may originate from the input module 90, the ballot module 80, and/or the monitor 86. After receiving an interrupt or as a result of an instruction received while polling, the system software 93 moves from step 2.C5 to step 2.C6, wherein the system software 93 determines if the personality file 100 shall be loaded and integrated into the system software 93. If the system software 93 determines in step 2.C6 that the personality file 100 shall be loaded, the system software 93 loads and integrates the personality file 100 in step 2.C7. When the system software 93 determines in step 2.C6 to not load and to integrate the personality file 100 (possibly because the personality file 100 was previously loaded and integrated), the system software 93 proceeds from step 2.C6 to step 2.C8. In step 2.C8 the system software 93 determines whether the operator has issued a command, such as a request for data. If the operator has issued a command from, for example, the input module 90, that has previously not been responded to, or not sufficiently responded to, the system software 93 directs the CPU 104 to execute the command in optional step 2.C9. The result of the execution in step 2.C9 of the command detected in step 2.C8 is displayed via the output module 92 in step 2.C10. When no outstanding unfulfilled command is detected in step 2.C8, the system software proceeds to step 2.C11 and queries the ballot module 80 whether a ballot 98 is available for reading by the ballot reader 103. If no ballot is available for reading at the time of execution of step 2.C11, the system software proceeds on to step 2.C5. If a ballot 98 is available at the time of execution of step 2.C1 the tabulator 82 issues a unique identification number (hereafter "ID")in step 2.C12. The ID is used by the ballot marker 112 and in elements E, records R and messages M to associate a ballot 98 with the operational information related to the reading and processing of the associated ballot 98. The tabulator 82 moves on from step 2.C12 to execute step 2.C13, wherein the CPU 104 reads the ballot image message sent by the ballot module 80 and loops through steps 2.C14 and 2.C13 until no more ballot image messages related to the same ballot 98 are available. In step 2.C15 the tabulator 82 interprets the ballot image messages as informed and/or directed by the personality file 100 and in step 2.C16 the tabulator increments vote counts, also as directed and informed by the personality file 100. In step 2.C17 the ballot 98 is marked with a mark derived at least partially from the ID generated in step 2.C12 and associated with the ballot 98 being marked. In step 2.C18 the ballot 114 router transfers the ballot 98 to a ballot bin 116 according to a determination of type as, e.g., Normal, Spoiled, or Provisional. It is understood that the monitor harvests the ballot identification number from the Address Bus 16 and Data Bus 18 and optionally writes the ballot identification number into one or more elements E and/or records R generated on the basis of the ballot 98 associated with the ballot identification number. The system software proceeds from step 2.C18 onto step 2.C5. It is understood that a command issued via the input module 90, or the Internet 40 to power down the vote tabulation system 74 may be executed in step 2.C9, whereupon the ballot module 80 ceases to read votes and the tabulator 82 stops counting votes.

Referring now generally to the Figures and particularly to FIG. 3, FIG. 3 is an element E of a session record R as stored in the monitor of FIGS. 1 and 2. The operational data S1 includes the address data S2 read from the Address Bus 16, data bus data S3 read from the Data Bus 18, control & status data read S4 from the Control and Status Lines 20, and ballot image data S5. The ballot image data S5 originates from the electronic ballot image related to the other operational data S1. The session record element E also includes a time date stamp S6 and a ballot identification number S7, where both the time date stamp S6 and the identification number S7 are associated with the ballot, and the reading of the ballot 98 by the ballot reader 80, from which the electronic ballot image was generated.

Referring now generally to the Figures, and particularly to FIG. 4, FIG. 4 is a plurality of session record elements E forming a session record R, where each element E provides operational information derived from or related to one specific ballot 98.

Referring now generally to the Figures, and particularly to FIG. 5, FIG. 5 is a schematic of a plurality of remote client receivers 78 and alternate or optional client transceiver 118 in combination with the vote tabulation system 74 of FIG. 1, where the vote tabulation system 74 is configured for bidirectional communications with the client transceiver. Each remote client receiver 78 and the client transceiver 118 are configured to receive session record elements E and checksums of the session record elements E by wireless transmission from the vote tabulation system 74.

Referring now generally to the Figures, and particularly to FIG. 6, FIG. 6 is a schematic of a remote client receiver 78 of FIG. 1 shown having an optional or alternate configuration as a client transceiver 118. The wireless transceiver 118 is configured for unidirectional or optionally bidirectional communications with the vote tabulation system 74 via the transmitter 88 of the monitor 86. A CPU 122 of the transceiver 118 is communicatively coupled with a telephone access port 124, an Internet access circuit 126, a high capacity memory storage device 128, a decryption module 130, an output video display 132, a keyboard 134, and a client memory device 136. The client receiver software 70 may enable a user to select a mode and channel of communications in which the client receiver 118 communicates with the monitor 86. The selection of the communications mode or channel may be accomplished automatically by the client receiver 118 or as directed by a user via the keyboard 134. The transceiver 120 of the client receiver 118 receives the session record elements E and stores these elements E in the high capacity memory storage device 128. The transceiver 118 may alternatively or additionally transmit the received session record elements E via the telephone access port 124 to a telephony network and/or the Internet via the Internet access circuit 126. The keyboard 134 enables a user of the transceiver 118 to request and receive access to the session record elements E stored in the high capacity memory storage device 128. The output video display 132 is used to visually present session records R and session record elements E to the user. The decryption module 130 is used by the CPU 122 and the client software to decrypt session records R and session record elements E. The client memory device may optionally store or include an enable key, where the enable key is used by the transceiver 118 to (1) validate the transceiver's authorization to receive session record elements E, (2) enable the encryption module to decrypt encrypted session record elements E, and/or (3) authorize the transceiver 118 to operate at a performance level superior to a basic 70.

Referring now generally to the Figures and particularly to FIG. 6A, FIG. 6A is a software flowchart of an alternate preferred embodiment of the client software 70 of the client receiver 78 of FIGS. A, 1 and 3. In step 6.1 the client receiver 78 boots up. The client software 70 directs the CPU 122 to determine in step 6.2 if a session record element E is being transmitted. If a session record element E is being transmitted proximate to the execution of step 6.2, the session record element E is read by the CPU 122 and optionally data compressed in step 6.3 by means of the application of a suitable data compression technique known in the art by the client CPU 122 and the high capacity storage device 128. The session record element E is stored in the high capacity storage device 128 in step 6.4. The CPU 122 then proceeds from step 6.4 to step 6.3. when there is no session record element E available to be received proximate to the execution of step 6.2, the transceiver 118 determines in step 6.5 if the session records R and elements E stored in the high capacity storage device shall be visually presented by means of the video display device 132. If no data is to be displayed, the transceiver 118 executes step 6.6 and determines whether the transceiver 118 shall stop receiving and storing session record elements and execute step 6.7. If the transceiver 118 is directed to by the Client CPU 122 to continue to be available to receive and store session record elements E, step 6.2 is then executed again. When the transceiver determines in step 6.5 that data is to be displayed on the video display 132, the CPU 122 optional executes step 6.8 and decrypts the data selected for display. In step 6.9 the data is displayed, and in step 6.10 the client software 70 determines whether the transceiver 118 shall stop operations and execute step 6.11, or alternatively proceed on to step 6.12. In step 6.12 the client receiver 118 determines whether to execute step 6.13 and perform data compression of data, to include operational information, Elements E, Records R and/or messages M, stored in the high capacity memory device 128 and/or the memory client memory device 136. The client transceiver 118 proceeds from either step 6.13 or step 6.12 to step 6.12 to resume being available for reception of an Element E or other electronic message from the vote tabulation system 74.

Referring now generally to the Figures, and particularly to FIG. 7, FIG. 7 is a process diagram of the operational phases of the first version 73 of FIG. 1. In step 7.1 the client 78 and the vote tabulation system 74 perform pre-election system software diagnostics. In step 7.2 the first system 73 performs operational checks and tabulates votes. In step 7.3 the first version 73 performs post-election system software diagnostics and election history confirmation.

Referring now generally to the Figures, and particularly to FIG. 8, FIG. 8 is a process diagram of the pre-election operational phase of the vote tabulation system 74 of FIG. 1. In step 8.1 the vote tabulation system 74 powers up. In step 8.2 vote tabulation system 74 transmits test messages. In step 8.3 the vote tabulation system 74 loads the personality file 100. In step 8.4 the vote tabulation system 74 runs software diagnostics and reports any discovered fatal operational conditions. In step 8.5 the vote tabulation system 74 reports when the vote tabulation system has passed software diagnostics and is ready to tabulate votes.

Referring now generally to the Figures, and particularly to FIG. 9, FIG. 9 is a process diagram of the pre-election operational phase of the remote client receiver of FIG. 1 and the client transceiver 118 of FIGS. 5 and 6. In step 9.1 the client receiver 78/client transceiver 118 powers up. In step 9.2 the client receiver 78/client transceiver 118 loads and initiates execution of the client software 93. In step 9.3 the client receiver 78/client transceiver 118 loads the client personality file 72. In step 9.4 the client receiver 78/client transceiver 118 runs software diagnostics and confirms that the client software 93 and the client personality file 72. The client receiver reports in step 9.5 that the client receiver is prepared to monitor the vote tabulation system 74 if the client receiver 78/client transceiver 118 has (1) successfully loaded the client software 93, and (2) the client personality file 72 and had passed system software diagnostics.

Referring now generally to the Figures, and particularly to FIG. 10, FIG. 10 is a process diagram of the tabulator 82 and the client 78 proximate to and during an election process. In step T1 the tabulation system 74 powers up and initiates transmission. In step T2 the tabulator 82 runs software diagnostics and transmits a memory dump to the client receiver 78. In step T3 the tabulator 82 waits for the ballot module to report that ballots 98 have begun to be input to the ballot module 80. In step T4 the tabulator 82 counts votes and directs the ballot module to read, sort and mark the ballots 98. In step T5 the vote tabulation reports final results of the vote counting. In step T6 the vote tabulator 82 is powered down. In step C1 the client receiver C1 is powered up. In step C2 the client receiver 78 searches for transmissions from the vote tabulation system 74. In step C3 the client receiver 78 stores messages transmitted from the vote tabulation system 74 while optionally presenting information derived from the operational information to user of the client receiver 78. It is understood that step C3 may be repeated many times while the client receiver 78 is receiving operational information from the vote tabulation system 74. In step C4 the client receiver 78 analyzes the operational information and displays election results. In step C5 the client receiver continues to be available to receive transmissions from the vote tabulation system 74.

Referring now generally to the Figures, and particularly to FIG. 11, FIG. 11 is a process diagram of the post-election operational process of the vote tabulation system 74 of FIG. 1. In step 11.1 the tabulator 82 is powered up. In step 11.2 the tabulator 82 initiates a transmission to the client receiver 78 via the monitor 86. In step 11.3 the tabulator 82 runs software diagnostics and tests on the vote tabulation system 74. In step 110.4 the tabulator 82 verifies and reports if the vote tabulation system has passed the software diagnostics and tests of step 11.3. In step 11.5 the vote tabulation system 74 powers off.

In certain still alternate preferred embodiments of the method of the Present Invention, the computational engine is directed by the system software to compute a checksum for an element of the computational activity history, and the checksum is then communicated via the monitor as a public rectory. The Method of the Present Invention may be implemented via the second version and include the steps of (i.) receiving the ballots from the voters with vote selections indicated; (ii.) tabulating the ballots with the second version; and (iii.) providing a history of the activity of the second version in tabulating the ballots, "history", as a public rectory.

Certain still alternate preferred embodiments of the Method of the Present Invention include one or more of the optional steps of (i.) releasing copies of the system software of the second version as a public record; (ii.) providing system software to the second system by means of a removable electronic module, e.g., a PCMCIA card; (iii.) providing a basic client software to the public for use in analyzing the history; (iv.) releasing an optimized client software that enhances superior analysis of the history. The system software may be provided in the form of source code, compiled code, and/or microprocessor readable machine language in certain other alternate preferred embodiments of the Method of the Present Invention. The basic or optimized client software may optionally be provided on a free, paid license, and/or fee-per-use bases. The basic client software and/or the history may be provided to the second version and/or released to the public in an encrypted format. The method used to encrypt the history may perform the encryption at least partially in view of information derived from a personality file of a selected election.

In certain still other alternate preferred embodiments of the Method of the Present Invention a checksum is generated by the second version on the basis of at least part of the history. The checksum may be communicated in association with the history and as public rectory. The Method may optionally further comprise generating a plurality of unique session records, where each unique session record is associated with an individual ballot. One or more unique session records may optionally be associated with (1.) a unique serial number, (2.) a time date stamp, and/or (3.) a marking on the ballot.

A still other alternate preferred embodiment of the Method of the Present Invention includes providing as public record a history of each of a plurality of automated vote tabulators, where the history comprises (1) a substantially complete copy of a system software of each vote tabulator, (2) substantially all data and information input and output of each vote tabulator instantiated during the vote counting, (3) a record of the substantive computational activity of each vote tabulator instantiated during the vote counting, and (4) a computational result of the vote processing of each vote tabulator.

Although the examples given include many specificities, they are intended as illustrative of only certain possible embodiments of the invention. Therefore, it is to be understood that the invention may be practiced other than as specifically described herein. Other embodiments and modifications will, no doubt, occur to those skilled in the art. The above description is intended to be illustrative, and not restrictive. Thus, the examples given should only be interpreted as illustrations of some of the preferred embodiments of the invention, and the full scope of the invention should be determined by the appended claims and their legal equivalents. Those skilled in the art will appreciate that various adaptations and modifications of the just-described preferred embodiments can be configured without departing from the scope and spirit of the invention. Other suitable techniques and methods known in the art can be applied in numerous specific modalities by one skilled in the art and in light of the description of the Present Invention described herein. Many other embodiments will be apparent to those of skill in the art upon reviewing the above description. The scope of the invention as disclosed and claimed should, therefore, be determined with reference to the knowledge of one skilled in the art and in light of the disclosures presented above.

I claim:

1. A transparent tabulation system, the system comprising:

a computational engine, the engine comprising a CPU, a memory, an input module and an output module, the computational engine processing data and instructions received from the input module in accordance with a system software stored at least partially in the memory, and the computational engine providing results of CPU processing to the output module;

a monitor, the monitor communicatively coupled with the computational engine and reading the activity of the computational engine, and the monitor communicating a history of the computational activity of the computational engine for storage as a public record;

a wireless transmitter communicatively coupled with the monitor whereby the history of computational activity is transmitted via a wireless communications mode, wherein the wireless transmitter has multi-channel capability and the wireless transmitter is configured with auto- selection capability of a communications channel by the monitor from a plurality of communications channels, wherein the wireless transmitter is configured to enable user selection of a communications channel from a plurality of communications channels.

2. A method of vote tabulation monitoring, the method comprising a. Receiving a plurality of ballots from voters with vote selections indicated; b. Tabulating the vote selections indicated by each of the plurality of ballots with a computational tabulation system; and c. Providing a history of the activity of the computational vote tabulation system in tabulating the ballots, "history", as a public record, the history comprising a record of the each logical state instantiated by the CPU in computing the tabulation results.

3. The method of claim 2, wherein the method further comprising generating a plurality of unique session records, each unique session record associated with an individual ballot.

4. The method of claim 3, wherein at least one unique session record is further associated with a unique serial number.

5. The method of claim 2, wherein at least one unique session record is further associated with a time date stamp.

6. The method of claim 2, wherein at least one ballot is marked for association with a unique session record.

7. The method of claim 2, wherein the history is provided in an encrypted form.

8. The method of claim 2, wherein the history is encrypted at least partially on the basis of a personality file of a selected election.

9. A method of improving confidence in the legitimacy of an election, the method comprising providing as public record a history of each of a plurality of automated vote tabulators, the history comprising a substantially complete copy of a system software of each vote tabulator, substantially all data and information input and output of each vote tabulator instantiated during the vote counting, a record of discrete and executed logical states of at least one CPU of each vote tabulator exhibited during the vote counting, and a computational result of the vote processing of each vote tabulator.

* * * * *